US009995044B2

(12) United States Patent
Suzuki

(10) Patent No.: US 9,995,044 B2
(45) Date of Patent: Jun. 12, 2018

(54) SECURING MEMBER FOR EXTERIOR MEMBERS AND EXTERIOR STRUCTURE

(71) Applicant: Nichiha Corporation, Nagoya-shi, Aichi (JP)

(72) Inventor: Kenji Suzuki, Nagoya (JP)

(73) Assignee: NICHIHA CORPORATION, Nagoya-Shi (JP)

( * ) Notice: Subject to any disclaimer, the term of this patent is extended or adjusted under 35 U.S.C. 154(b) by 0 days. days.

(21) Appl. No.: 15/423,786

(22) Filed: Feb. 3, 2017

(65) Prior Publication Data

US 2017/0268237 A1 Sep. 21, 2017

(30) Foreign Application Priority Data

Mar. 16, 2016 (JP) ..... 2016-052810
Mar. 16, 2016 (JP) ..... 2016-052821

(51) Int. Cl.
*E04F 13/08* (2006.01)
*E04B 1/41* (2006.01)
(Continued)

(52) U.S. Cl.
CPC ..... *E04F 13/0832* (2013.01); *E04B 1/40* (2013.01); *E04F 13/0826* (2013.01);
(Continued)

(58) Field of Classification Search
CPC ... E04F 13/08; E04F 13/0826; E04F 13/0832; E04F 13/0846; E04F 13/0864; E04B 2/70; E04B 2001/405
See application file for complete search history.

(56) References Cited

U.S. PATENT DOCUMENTS 6,402,419 B1 * 6/2002 Watanabe ..... E04F 13/0846 248/220.22
6,598,362 B2 * 7/2003 Hikai ..... E04F 13/0846 52/235
(Continued)

FOREIGN PATENT DOCUMENTS

JP 2001-220882 A 8/2001
JP 2002-81186 A 3/2002
(Continued)

*Primary Examiner* — Paola Agudelo
(74) *Attorney, Agent, or Firm* — Birch, Stewart, Kolasch & Birch, LLP

(57) ABSTRACT

A securing member includes a fixing portion having a reference surface and fixing holes, a main bulging portion having a contact surface that comes into contact with first to fourth exterior members, a supporting portion, upper and lower engagement portions attached to the supporting portion, a lower bulging portion, and an erected portion that projects from the lower bulging portion and that is disposed on a center line of the fixing portion between the first and third exterior members. One of the fixing holes that is closest to the center line is displaced from the center line. The fixing holes are arranged asymmetrically about the center line. A first length by which the main bulging portion bulges is greater than a second length by which the lower bulging portion bulges. The length from the reference surface to the front end of the erected portion is greater than the first length.

8 Claims, 23 Drawing Sheets

(51) Int. Cl.
*E04B 2/70* (2006.01)
*E04B 1/38* (2006.01)
*E04F 13/14* (2006.01)

(52) U.S. Cl.
CPC ..... *E04F 13/0846* (2013.01); *E04F 13/0864* (2013.01); *E04B 2/70* (2013.01); *E04B 2001/405* (2013.01); *E04F 13/0894* (2013.01); *E04F 13/142* (2013.01); *E04F 13/147* (2013.01)

(56) References Cited

U.S. PATENT DOCUMENTS 8,979,052 B2 * 3/2015 Uota ..... E04F 13/0846 248/226.11
9,470,000 B1 * 10/2016 Ochi ..... E04F 13/0826
2002/0095889 A1 * 7/2002 Hikai ..... E04F 13/0826 52/235
2012/0198789 A1 * 8/2012 Noutsis ..... E04F 21/0092 52/747.11
2015/0275527 A1 * 10/2015 Porter ..... E04F 13/08 52/701
2016/0040433 A1 * 2/2016 Sawada ..... E04F 13/085 52/506.05
2016/0289976 A1 * 10/2016 Suzuki ..... E04F 13/007

FOREIGN PATENT DOCUMENTS

JP 2002-220910 A 8/2002
JP 2007-262777 A 10/2007

* cited by examiner

SECURING MEMBER FOR EXTERIOR MEMBERS AND EXTERIOR STRUCTURE

CROSS REFERENCES TO RELATED APPLICATIONS

This application is based on Japanese Patent Application No. 2016-052810 filed in the Japanese Patent Office on Mar. 16, 2016 and Japanese Patent Application No. 2016-052821 filed in the Japanese Patent Office on Mar. 16, 2016, the entire contents of which are hereby incorporated by reference.

BACKGROUND OF THE INVENTION

1. Field of the Invention

The present invention relates to a securing member for exterior members and an exterior structure of a building.

2. Description of the Related Art

Japanese Unexamined Patent Application Publication No. 2002-220910 (Patent Document 1) and Japanese Unexamined Patent Application Publication No. 2002-81186 (Patent Document 2) disclose securing members for exterior members. The securing members according to Patent Documents 1 and 2 are used to secure exterior members of a four-side shiplap structure. Each securing member includes a fixing portion that is fixed to a framework, a supporting portion that projects from the fixing portion, an upper engagement portion provided on the supporting portion so as to extend upward, and a lower engagement portion provided on the supporting portion so as to extend downward. The supporting portion supports two exterior members that are located at an upper side. The upper engagement portion engages with the two exterior members at the upper side. The lower engagement portion engages with two exterior members that are located at a lower side.

Each securing member further includes a fixing hole that is formed in the fixing portion and through which a fastener is inserted, and an erected portion that is disposed between opposing ends of the two exterior members at the lower side.

The securing member disclosed in Patent Document 1 includes a plurality of fixing holes that are formed in an upper section of the fixing portion and through which screws, which serve as fasteners, are inserted. The erected portion projects from a lower section of the fixing portion.

More specifically, the securing member disclosed in Patent Document 1 includes a pair of spacer portions at both sides of the fixing portion. The pair of spacer portions are bent so as to project toward the front of the securing member. Contact surfaces are formed at the distal ends of the pair of spacer portions so as to extend vertically. The contact surfaces support back surfaces of four exterior members that are vertically and horizontally adjacent to each other. The upper engagement portion engages with the two exterior members at the upper side. The lower engagement portion engages with the two exterior members at the lower side. The erected portion is formed on a lower section of the fixing portion. The erected portion is disposed between the opposing ends of the two exterior members at the lower side so as to prevent sideways displacement of the exterior members.

The securing member disclosed in Patent Document 2 includes a sealing member and an attaching member that are combined together. The sealing member has a plurality of through holes formed in an upper section of the fixing portion, and the attaching member also has a plurality of through holes formed in a step portion and a fixing plate portion so as to correspond to the through holes in the sealing member. The erected portion projects from a lower section of the fixing portion of the sealing member.

A securing member disclosed in Japanese Unexamined Patent Application Publication No. 2001-220882 (Patent Document 3) includes a bulging portion. The bulging portion has an opening. A section of the bulging portion that is above the opening and two ribs that project at locations below the opening form contact surfaces. An upper engagement portion and a lower engagement portion are raised at the periphery of the opening in the bulging portion.

A securing member disclosed in Japanese Unexamined Patent Application Publication No. 2007-262777 (Patent Document 4) also includes a bulging portion. The bulging portion includes a pair of further bulging portions that further bulge at one and the other sides of the bulging portion in the width direction, and has an opening. Contact surfaces are formed at the distal ends of the pair of further bulging portions so as to extend vertically. An upper engagement portion and a lower engagement portion are raised at the periphery of the opening in the bulging portion.

In the securing member disclosed in Patent Document 1, one of the through holes that is closest to the center line of the fixing portion in the width direction is disposed on the center line, and the erected portion is displaced from the center line in the width direction. Therefore, when the load of the exterior members is supported by the supporting portion, the upper engagement portion, and the lower engagement portion, the length over which two of the exterior members that are located at one side in the width direction are supported is not equal to the length over which two of the exterior members that are located at the other side in the width direction are supported. Thus, the load is not easily balanced between one and the other sides in the width direction.

In the securing member disclosed in Patent Document 2, one of the through holes that is closest to the center line of the fixing portion in the width direction is disposed on the center line, and the erected portion is also disposed on the center line in the width direction. Therefore, when the load of the exterior members is supported by the supporting portion, the upper engagement portion, and the lower engagement portion, the length over which two of the exterior members that are located at one side in the width direction are supported is equal to the length over which two of the exterior members that are located at the other side in the width direction are supported. Thus, the load is balanced between one and the other sides in the width direction.

However, in the case where the securing member is fixed to a thin structural member, if the securing member is fixed to the structural member so that the abutting line between the front surfaces of the two exterior members at the lower side is near the center of the structural member, the erected portion on the center line of the fixing portion in the width direction is easily disposed near a side surface of the structural member. Accordingly, the through hole on the center line is also easily disposed near the side surface of the structural member. In such a case, there is a risk that the fastener, such as a nail or a screw, that is inserted through the through hole on the center line will protrude from the side surface of the structural member or the side surface of the structural member will break.

Thus, when the above-described securing members according to the related art are used, it is difficult to support the load of the exterior members with good balance in the width direction, and it is also difficult to ensure good construction performance when the securing members are fixed to a thin structural member.

In the securing members disclosed in Patent Documents 1, 3, and 4, the contact surfaces tend to be long in the vertical direction to ensure that the contact surfaces have a sufficiently large area to stably support the exterior members. Accordingly, when the exterior members receive a rotating force due to wind pressure or the like, corners of the contact surfaces easily abut against the back surfaces of the exterior members. As a result, there is a risk that the back surfaces of the exterior members will be damaged by the securing members disclosed in Patent Documents 1, 3, and 4.

SUMMARY OF THE INVENTION

The present invention has been made in light of the above-described problems of the related art, and an object of the present invention is to provide a securing member for exterior members and an exterior structure of a building with which load of the exterior members can be supported with good balance in the width direction and which provides good construction performance even when the securing member is fixed to a thin structural member. Another object of the present invention is to provide a securing member for exterior members and an exterior structure of a building in which contact surfaces have a sufficiently large area to stably support the exterior members and damage to the back surfaces of the exterior members by the contact surfaces can be reduced.

A securing member according to a first aspect of the present invention is used to attach a first exterior member, a second exterior member, a third exterior member, and a fourth exterior member to a framework of a building, the second exterior member being adjacent to and above the first exterior member, the third exterior member being adjacent to the first exterior member at one side in a horizontal direction, the fourth exterior member being adjacent to and above the third exterior member and being adjacent to the second exterior member at the one side in the horizontal direction. The securing member includes a fixing portion that includes a reference surface, that is fixed to the framework at the reference surface, and that has at least one fixing hole that allows a fastener to be inserted through the fixing portion; a supporting portion that projects from the fixing portion and supports the second exterior member and the fourth exterior member; an upper engagement portion that is provided on the supporting portion so as to extend upward and engages with the second exterior member and the fourth exterior member; a lower engagement portion that is provided on the supporting portion so as to extend downward and engages with the first exterior member and the third exterior member; and an erected portion that projects from the fixing portion and that is disposed between opposing end portions of the first exterior member and the third exterior member. The erected portion is disposed on a center line of the fixing portion in a width direction. A specific fixing hole, which is one of the at least one fixing hole that is closest to the center line, is displaced from the center line toward one side in the width direction. The at least one fixing hole is arranged asymmetrically about the center line.

In the securing member for the exterior members according to the first aspect of the present invention, the erected portion is disposed on the center line of the fixing portion in the width direction. Therefore, when the supporting portion, the upper engagement portion, and the lower engagement portion support the load of the first to fourth exterior members, the length over which the first and second exterior members disposed at one side in the width direction are supported is equal to the length over which the third and fourth exterior members disposed at the other side in the width direction is supported. Thus, the load is balanced between one and the other sides in the width direction. In addition, in this securing member, the specific fixing hole, which is one of the at least one fixing hole that is closest to the center line, is displaced from the center line in the width direction. Therefore, in the case where the securing member is fixed to a thin structural member, even when the securing member is fixed to the structural member so that the abutting line between the front surfaces of the first and third exterior members is near the center of the structural member, the specific fixing hole is not easily disposed near either side surface of the structural member. As a result, the risk that a fastener inserted through the specific fixing hole will protrude from a side surface of the structural member and the risk that the side surface of the structural member will break can be reduced. Similar to the specific fixing hole, fixing holes other than the specific fixing hole may also be displaced from the center line in the width direction. In such a case, the other fixing holes are also not easily disposed near either side surface of the structural member. As a result, the risk that fasteners inserted through these fixing holes will protrude from a side surface of the structural member and the risk that the side surface of the structural member will break can be reduced.

Accordingly, the securing member for the exterior members according to the first aspect of the present invention is capable of supporting the load of the exterior members with good balance in the width direction, and provides good construction performance even when the securing member is fixed to a thin structural member.

According to a second aspect of the present invention, preferably, one end portion of each exterior member in the horizontal direction includes a back horizontally joining portion that is recessed from a front surface of the exterior member toward a back surface of the exterior member and that extends in a vertical direction. In addition, preferably, the other end portion of each exterior member in the horizontal direction includes a front horizontally joining portion that is recessed from the back surface of the exterior member toward the front surface of the exterior member and that extends in the vertical direction. With this configuration, the back horizontally joining portion of the first exterior member and the front horizontally joining portion of the third exterior member overlap at a position displaced from the center line toward one side in the width direction. In other words, the specific fixing hole is disposed within a range in which the back horizontally joining portion and the front horizontally joining portion overlap or at a position near the range. Accordingly, in the case where the securing member is fixed to a thin structural member, even when the securing member is fixed to the structural member so that the abutting line between the front surfaces of the first and third exterior members is near the center of the structural member, the specific fixing hole is not easily disposed near either side surface of the thin structural member. As a result, the securing member provides higher construction performance.

According to a third aspect of the present invention, preferably, a distance by which the specific fixing hole is displaced from the center line is greater than or equal to ¼ of an overlapping width by which the back horizontally joining portion and the front horizontally joining portion overlap, and is less than or equal to ¾ of the overlapping width. With this configuration, the risk that the specific fixing hole will be disposed near a side surface of the thin structural member can be further reduced. As a result, the securing member provides still higher construction performance.

According to a fourth aspect of the present invention, preferably, a plurality of the specific fixing holes are arranged in a vertical direction. With this configuration, the securing member can be more securely fixed to the structural member by using the specific fixing holes arranged in the vertical direction. In particular, the securing member can be prevented from rotating.

An exterior structure of a building according to a fifth aspect of the present invention includes a plurality of exterior members including a first exterior member, a second exterior member, a third exterior member, and a fourth exterior member; a framework of the building; and a securing member for attaching the plurality of exterior members to the framework. The second exterior member is adjacent to and above the first exterior member. The third exterior member is adjacent to the first exterior member at one side in a horizontal direction. The fourth exterior member is adjacent to and above the third exterior member, and is adjacent to the second exterior member at the one side in the horizontal direction. The securing member includes a fixing portion that includes a reference surface, that is fixed to the framework at the reference surface, and that has at least one fixing hole that allows a fastener to be inserted through the fixing portion; a supporting portion that projects from the fixing portion and supports the second exterior member and the fourth exterior member; an upper engagement portion that is provided on the supporting portion so as to extend upward and engages with the second exterior member and the fourth exterior member; a lower engagement portion that is provided on the supporting portion so as to extend downward and engages with the first exterior member and the third exterior member; and an erected portion that projects from the fixing portion and that is disposed between opposing end portions of the first exterior member and the third exterior member. The erected portion is disposed on a center line of the fixing portion in a width direction. A specific fixing hole, which is one of the at least one fixing hole that is closest to the center line, is displaced from the center line toward one side in the width direction. The at least one fixing hole is arranged asymmetrically about the center line.

With this configuration, owing to the operational effect obtained by the securing member according to the present invention, the exterior members can be appropriately supported and good construction performance can be provided.

A securing member according to a sixth aspect of the present invention is used to attach a first exterior member, a second exterior member, a third exterior member, and a fourth exterior member to a framework of a building, the second exterior member being adjacent to and above the first exterior member, the third exterior member being adjacent to the first exterior member at one side in a horizontal direction, the fourth exterior member being adjacent to and above the third exterior member and being adjacent to the second exterior member at the one side in the horizontal direction. The securing member includes a fixing portion that includes a reference surface and that is fixed to the framework at the reference surface; a main bulging portion that bulges from the fixing portion; a contact surface that is formed on the main bulging portion and that comes into contact with back surfaces of the first exterior member, the second exterior member, the third exterior member, and the fourth exterior member; a supporting portion that projects beyond the contact surface of the main bulging portion, that extends in a width direction of the main bulging portion, and that supports the second exterior member and the fourth exterior member; an upper engagement portion that is attached to the supporting portion and that engages with the second exterior member and the fourth exterior member; a lower engagement portion that is attached to the supporting portion and that engages with the first exterior member and the third exterior member; a lower bulging portion that bulges from the fixing portion and that is adjacent to and below the main bulging portion; and an erected portion that projects from the lower bulging portion and that is disposed between opposing end portions of the first exterior member and the third exterior member. A first length by which the main bulging portion bulges from the reference surface is greater than a second length by which the lower bulging portion bulges from the reference surface. A third length from the reference surface to a front end of the erected portion is greater than the first length.

According to a sixth aspect of the present invention, in the securing member for the exterior members, the first length by which the main bulging portion bulges from the reference surface is greater than the second length by which the lower bulging portion bulges from the reference surface. Therefore, the main bulging portion is effectively reinforced by the lower bulging portion. Accordingly, the contact surface has a sufficiently large area even when the length of the contact surface in the vertical direction is reduced, and the exterior members can be stably supported. In addition, since the lower bulging portion is below the main bulging portion, even when the first to fourth exterior members receive rotating forces due to wind pressure or the like, the lower bulging portion is prevented from coming into contact with the back surfaces of the first to fourth exterior members.

Therefore, according to the securing member for the exterior members of the sixth aspect of the present invention, the contact surface has a sufficiently large area so that the exterior members can be stably supported, and the risk that the contact surface will damage the back surfaces of the exterior members can be reduced.

In addition, in the securing member, the erected portion protrudes not from the reference surface but from the lower bulging portion. Accordingly, in the securing member, the length by which the erected portion projects can be reduced. Therefore, the strength of the erected portion is increased, and the erected portion is not easily bent. As a result, when the securing member is used, sideways displacement of the first and third exterior members can be more effectively prevented.

According to a seventh aspect of the present invention, the contact surface preferably includes a pair of horizontally extending surfaces that are above and below the supporting portion. In this case, since the main bulging portion is effectively reinforced by the lower bulging portion, the vertical gap between the pair of horizontally extending surfaces can be reduced. Accordingly, damage to the back surfaces of the exterior members can be effectively reduced.

According to an eighth aspect of the present invention, the contact surface preferably includes a pair of vertically extending surfaces that are on both sides of the main bulging portion in the width direction. In this case, since the main bulging portion is effectively reinforced by the lower bulging portion, the length of the pair of vertically extending surfaces in the vertical direction can be reduced. Accordingly, damage to the back surfaces of the exterior members can be effectively reduced.

According to a ninth aspect of the present invention, preferably, the contact surface includes a pair of horizontally extending surfaces that are above and below the supporting portion, and a pair of vertically extending surfaces that are on both sides of the main bulging portion in the width direction. In addition, preferably, the pair of horizontally extending surfaces and the pair of vertically extending surfaces form a loop. In this case, since the main bulging portion is effectively reinforced by the lower bulging portion, the vertical length of the area including the pair of horizontally extending surfaces and the pair of vertically extending surfaces can be reduced. In addition, the pair of horizontally extending surfaces and the pair of vertically extending surfaces form a loop, and therefore do not have end portions. As a result, when the securing member is used, damage to the back surfaces of the exterior members can be more effectively reduced.

According to a tenth aspect of the present invention, the second length is greater than half the first length. In this case, the lower bulging portion more effectively reinforces the main bulging portion while being prevented from coming into contact with the back surfaces of the first to fourth exterior members. In addition, since the erected portion protrudes not from the reference surface but from the lower bulging portion, the length by which the erected portion projects can be reduced. Accordingly, the strength of the erected portion is increased, and the erected portion is not easily bent.

According to an eleventh aspect of the present invention, preferably, a first opening is formed in the main bulging portion and a second opening is formed in the lower bulging portion.

In this case, the first opening formed in the main bulging portion and the second opening formed in the lower bulging portion face a ventilation space between the framework and the first to fourth exterior members. Accordingly, the first opening and the second opening serve as an inlet and an outlet that allow the air that flows through the ventilation space to flow into and out of the space surrounded by the securing member and the framework. As a result, the space surrounded by the securing member and the framework and portions of the exterior members and the framework disposed around the space surrounded by the securing member and the framework can be dried. Thus, deterioration of the exterior member and the framework can be reduced.

The first opening can be formed when, for example, the supporting portion, the upper engagement portion, and the lower engagement portion are raised, and the second opening can be formed when, for example, the erected portion is raised. Thus, the manufacturing process of the securing member can be simplified.

According to a twelfth aspect of the present invention, preferably, the securing member further includes an upper bulging portion that bulges from the fixing portion and that is adjacent to and above the main bulging portion. The main bulging portion preferably bulges from the reference surface beyond the upper bulging portion. In this case, the main bulging portion is also effectively reinforced by the upper bulging portion.

According to a thirteenth aspect of the present invention, the fixing portion preferably has a fixing hole through which a fastener is inserted. The upper bulging portion preferably includes a portion that is adjacent to the fixing hole in the width direction. In this case, a portion of the fixing portion that is fixed to the framework by the fastener comes into contact with the framework over a large area, and therefore the fixing portion can be securely fixed to the framework. In addition, at least a portion of a head portion of the fastener, which is a screw, a nail, or the like, is disposed behind the front surface of the upper bulging portion at both sides of the fastener. Therefore, when the second and fourth exterior members are engaged with the upper engagement portion, the second and fourth exterior members do not easily come into contact with the head portion of the fastener.

According to a fourteenth aspect of the present invention, the upper bulging portion is preferably inclined so that the length by which the upper bulging portion bulges from the reference surface increases toward the main bulging portion. In this case, when the second and fourth exterior members are engaged with the upper engagement portion, the lower end portions of the second and fourth exterior members can be appropriately guided since the upper bulging portion is inclined. As a result, damage due to snagging of the lower end portions of the second and fourth exterior members by a corner of a contact surface can be suppressed.

An exterior structure of a building according to a fifteenth aspect of the present invention includes a plurality of exterior members including a first exterior member, a second exterior member, a third exterior member, and a fourth exterior member; a framework of the building; and a securing member for attaching the plurality of exterior members to the framework. The second exterior member is adjacent to and above the first exterior member. The third exterior member is adjacent to the first exterior member at one side in a horizontal direction. The fourth exterior member is adjacent to and above the third exterior member, and is adjacent to the second exterior member at the one side in the horizontal direction. The securing member includes a fixing portion that includes a reference surface and that is fixed to the framework at the reference surface; a main bulging portion that bulges from the fixing portion; a contact surface that is formed on the main bulging portion and that comes into contact with back surfaces of the first exterior member, the second exterior member, the third exterior member, and the fourth exterior member; a supporting portion that projects beyond the contact surface of the main bulging portion, that extends in a width direction of the main bulging portion, and that supports the second exterior member and the fourth exterior member; an upper engagement portion that is attached to the supporting portion and that engages with the second exterior member and the fourth exterior member; a lower engagement portion that is attached to the supporting portion and that engages with the first exterior member and the third exterior member; a lower bulging portion that bulges from the fixing portion and that is adjacent to and below the main bulging portion; and an erected portion that projects from the lower bulging portion and that is disposed between opposing end portions of the first exterior member and the third exterior member. A first length by which the main bulging portion bulges from the reference surface is greater than a second length by which the lower bulging portion bulges from the reference surface. A third length from the reference surface to a front end of the erected portion is greater than the first length.

According to the exterior structure of the building of the fifteenth aspect of the present invention, owing to the operational effect of the securing member according to the sixth aspect, the contact surface has a sufficiently large area so that the exterior members can be stably supported, and the risk that the contact surface will damage the back surfaces of the exterior members can be reduced. In addition, according to the exterior structure of the building, the erected portion protrudes not from the reference surface but from the lower bulging portion. Therefore, the strength of the erected portion is increased, and the erected portion is not easily bent. As a result, sideways displacement of the first and third exterior members can be more effectively prevented.

According to a sixteenth aspect of the present invention, another securing member is used to attach a first exterior member, a second exterior member, a third exterior member, and a fourth exterior member to a framework of a building, the second exterior member being adjacent to and above the first exterior member, the third exterior member being adjacent to the first exterior member at one side in a horizontal direction, the fourth exterior member being adjacent to and above the third exterior member and being adjacent to the second exterior member at the one side in the horizontal direction. The securing member includes a contact surface that comes into contact with back surfaces of the first exterior member, the second exterior member, the third exterior member, and the fourth exterior member; a supporting portion that projects beyond the contact surface and that supports the second exterior member and the fourth exterior member; an upper engagement portion that is attached to the supporting portion and that engages with the second exterior member and the fourth exterior member; a lower engagement portion that is attached to the supporting portion and that engages with the first exterior member and the third exterior member; and a projection that projects upward from the supporting portion. The projection is located so as to be separated from a front end of the supporting portion toward the contact surface, the front end being adjacent to the upper engagement portion and the lower engagement portion, and separated from the contact surface toward the upper engagement portion and the lower engagement portion.

In the securing member according to the sixteenth aspect of the present invention, the projection comes into contact with end surfaces of the second and fourth exterior members from below, thereby forming a gap between the supporting portion and the second and fourth exterior members. The area in which the projection comes into contact with the end surfaces of the second and fourth exterior members is smaller than the area in which the supporting portion will come into contact with the end surfaces of the second and fourth exterior members if the projection is not provided. Therefore, rainwater that has flowed along the back surfaces of the second and fourth exterior members or along the joint portion between the second and fourth exterior members and accumulated on the supporting portion or rainwater that has been absorbed by dust, dirt, or the like on the supporting portion can be prevented from being in contact with the end surfaces of the second and fourth exterior members for a long time. As a result, the exterior members can be prevented from being damaged by being soaked with the rainwater or the like at the end surfaces thereof. A construction worker may install the first to fourth exterior members without realizing that foreign matter, such as dust and dirt, is on the supporting portion. Even in such a case, since the projection is provided, the foreign matter is prevented from being sandwiched, and the gap can be reliably formed between the supporting portion and the second and fourth exterior members. As a result, when the securing member is used, the gap between the supporting portion and the second exterior member and the gap between the supporting portion and the fourth exterior member can be accurately set without a vertical displacement so that the gap is large enough to prevent the accumulation of rainwater.

Thus, according to the other securing member for the exterior members according to the present invention, the second and fourth exterior members can be maintained in a good condition, and vertical displacement between the second and fourth exterior members can be prevented.

According to a seventeenth aspect of the present invention, the projection is preferably arranged at a center of the supporting portion in the width direction. In this case, the projection at the center of the supporting portion in the width direction provides a gap that is large enough to reduce the accumulation of rainwater between the supporting portion and the second and fourth exterior members.

According to an eighteenth aspect of the present invention, preferably, the other securing member further includes elastic members that are provided at least on the supporting portion at a position displaced from the center of the supporting portion in the width direction toward one side and a position displaced from the center of the supporting portion in the width direction toward the other side. In this case, the space between the second exterior member and the supporting portion and the space between the fourth exterior member and the supporting portion are sealed by the elastic members. Therefore, the rainwater is prevented from spreading in the width direction along the supporting portion. The second and fourth exterior members are arranged so as to squash the elastic members. At this time, a step having a height depending on the amounts by which the elastic members are squashed may be formed on the supporting portion, and the second and fourth exterior members may be displaced from each other in the vertical direction. However, since the projection is formed on the supporting portion, the second and fourth exterior members can be prevented from being displaced from each other in the vertical direction, and can be stably supported.

According to a nineteenth aspect of the present invention, the lower engagement portion is preferably located at the center of the contact surface in the width direction. In this case, the rainwater on the supporting portion flows downward along the lower engagement portion at the center of the securing member, and is prevented from spreading in the width direction along the supporting portion. As a result, the second and fourth exterior members can be maintained in a good condition.

According to a twentieth aspect of the present invention, the projection is preferably provided on the supporting portion at each of a position displaced from the center of the supporting portion toward one side and a position displaced from the center of the supporting portion in the width direction toward the other side. In this case, the second and fourth exterior members can be appropriately supported by different projections. As a result, a gap that is large enough to reduce the accumulation of rainwater can be provided between the supporting portion and the second and fourth exterior members.

According to a twenty-first aspect of the present invention, the supporting portion preferably has at least one through hole. In this case, the rainwater on the supporting portion flows downward through the through hole. Therefore, the rainwater is prevented from spreading in the width direction along the supporting portion.

According to a twenty-second aspect of the present invention, the projection is dot-shaped or linear. In this case, due to the shape of the projection, a gap that is large enough to reduce the accumulation of rainwater can be provided between the supporting portion and the second and fourth exterior members.

An exterior structure of a building according to a twenty-third aspect of the present invention includes a plurality of exterior members including a first exterior member, a second exterior member, a third exterior member, and a fourth exterior member; a framework of the building; and a securing member for attaching the plurality of exterior members to the framework. The second exterior member is adjacent to and above the first exterior member. The third exterior member is adjacent to the first exterior member at one side in a horizontal direction. The fourth exterior member is adjacent to and above the third exterior member, and is adjacent to the second exterior member at the one side in the horizontal direction. The securing member includes a contact surface that comes into contact with back surfaces of the first exterior member, the second exterior member, the third exterior member, and the fourth exterior member; a supporting portion that projects beyond the contact surface and that supports the second exterior member and the fourth exterior member; an upper engagement portion that is attached to the supporting portion and that engages with the second exterior member and the fourth exterior member; a lower engagement portion that is attached to the supporting portion and that engages with the first exterior member and the third exterior member; and a projection that projects upward from the supporting portion. The projection is located so as to be separated from a front end of the supporting portion toward the contact surface, the front end being adjacent to the upper engagement portion and the lower engagement portion, and separated from the contact surface toward the upper engagement portion and the lower engagement portion.

According to the exterior structure of the building of the twenty-third aspect of the present invention, owing to the operational effect of the securing member according to the sixteenth aspect, the rainwater that has accumulated on the supporting portion or the rainwater absorbed by dust and dirt on the supporting portion do not come into contact with the end surfaces of the second and fourth exterior members, and the second and fourth exterior members can be maintained in a good condition. In addition, vertical displacement between the second and fourth exterior members that occurs when foreign matter, such as dust and dirt, is sandwiched can be prevented.

According to the securing member for the exterior members and the exterior structure of the first to fifth aspects, the load of the exterior members can be supported with good balance in the width direction, and good construction performance can be provided even when the securing member is fixed to a thin structural member.

According to the securing member for the exterior members and the exterior structure of the sixth to twenty-third aspects, the contact surface has a sufficiently large area so that the exterior members can be stably supported, and the risk that the contact surface will damage the back surfaces of the exterior members can be reduced.

According to the other securing member for the exterior members and the other exterior structure according to the present invention, owing to the erected portion, the second and fourth exterior members do not come into contact with the rainwater that has accumulated on the supporting portion or the rainwater absorbed by dust and dirt on the supporting portion, and can be maintained in a good condition. In addition, vertical displacement between the second and fourth exterior members can be prevented.

DESCRIPTION OF THE PREFERRED EMBODIMENTS

Figure 1:
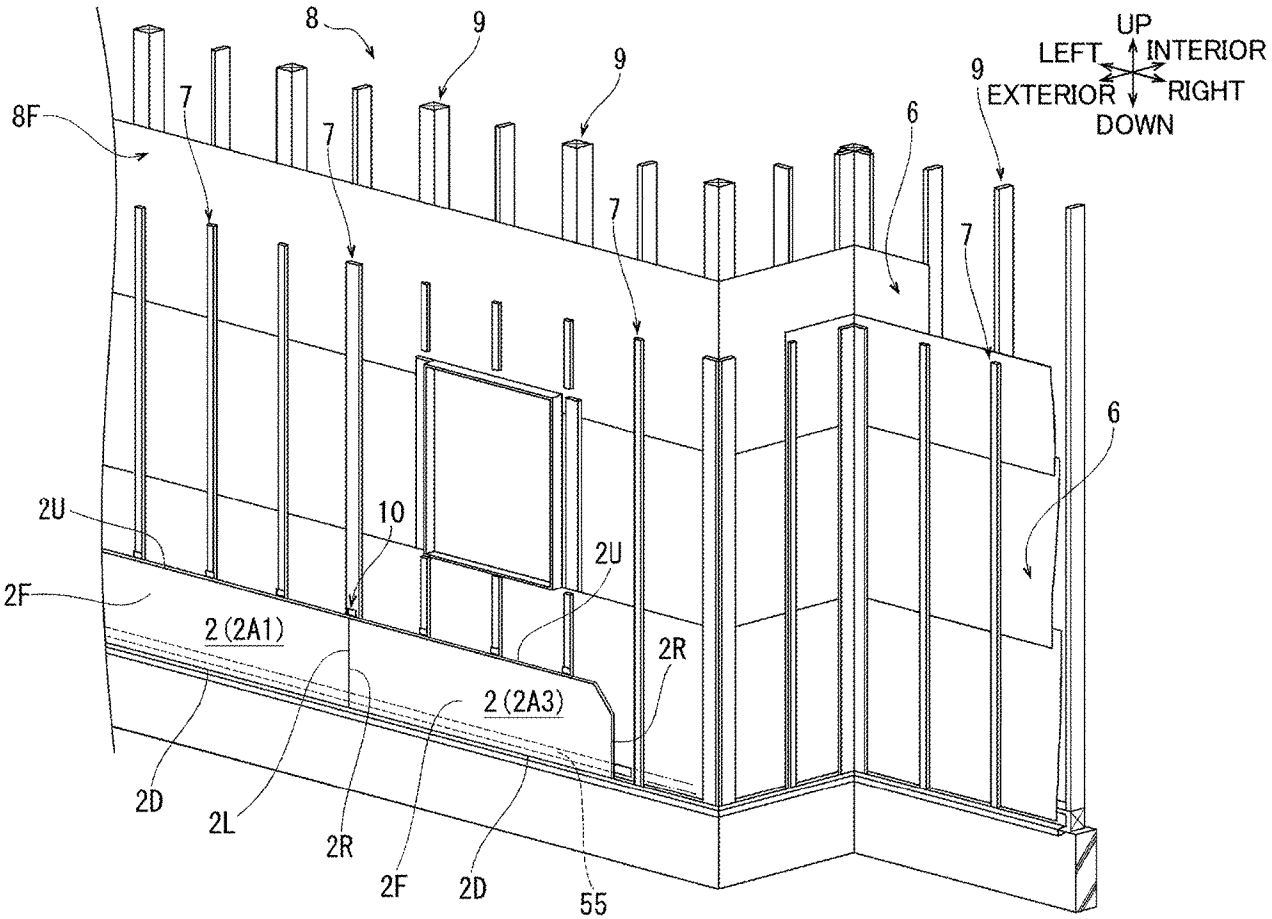
FIG. 1 is a perspective view of an exterior structure according to a first embodiment.

Embodiments of the present invention will be described below with reference to the drawings. In FIG. 1, "UP" denotes the vertically upward direction, and "DOWN" denotes the vertically downward direction. In addition, in FIG. 1, "LEFT" and "RIGHT" respectively denote the horizontally leftward and rightward directions when viewed in the direction from the exterior side to the interior side. The directions in FIG. 2 and the following drawings correspond to those in FIG. 1.

First Embodiment

FIG. 1 illustrates an exterior structure according to a first embodiment of the present invention. The exterior structure includes a wooden framework 8 of a building, such as a house, a facility, or a warehouse, and a plurality of exterior wall plates 2 illustrated in FIGS. 2 to 5 attached to the wooden framework 8. The exterior wall plates 2 are an example of "exterior members". The exterior wall plates 2 are plate members that have a high strength and rigidity and constitute an exterior wall of a building. The exterior members are not limited to the exterior wall plates, and may instead be, for example, decorative boards having a graphically designed front surface. Decorative boards are often attached to a strong body having an exterior wall, and the strength and rigidity thereof are generally lower than those of the exterior wall plates.

As illustrated in FIG. 1, in the first embodiment, the framework 8 is constructed by a wooden framework construction method. The framework 8 is formed of a plurality of structural members. The structural members include a plurality of columns 9 that are arranged with predetermined intervals therebetween in the horizontal direction and thin structural members 99, which will be described below with reference to FIG. 19. The thin structural members 99 are, for example, thin columns 9 or auxiliary members such as studs. Support members 7 called furring strips are fixed to the outer surfaces of the columns 9 that face the exterior side with fastening screws or nails (not shown). The structural members also include the support members 7. A waterproof sheet 6 is provided between the columns 9 and the support members 7. The structure of the framework 8 is not limited to that in the present embodiment, and the framework 8 may instead be constructed by, for example, framing. The framework of the exterior structure may be made of, for example, steel, reinforced concrete, or brick.

Figure 6:
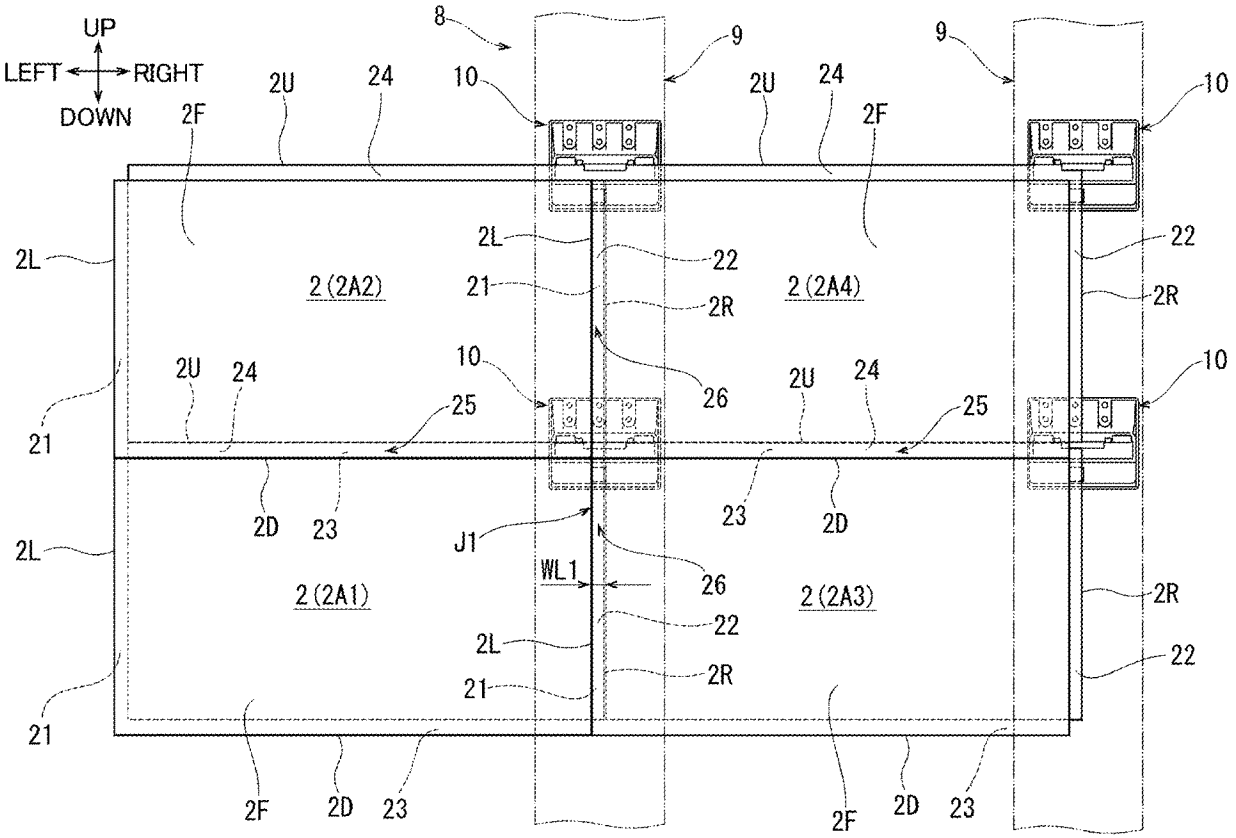
FIG. 6 is a front view illustrating the positional relationship between the first to fourth exterior wall plates and securing members according to the first embodiment.

As illustrated in FIG. 6, securing members 10 are fixed to the columns 9, which are structural members, so that the exterior wall plates 2 are attached to the framework 8 so as to be horizontally and vertically adjacent to each other. Multiple securing members 10 are vertically arranged along each column 9. As described below with reference to FIG. 19, multiple securing members 10 are also vertically arranged along each thin structural member 99. As illustrated in FIGS. 7 to 13, the securing members 10 are formed by punching, pressing, or bending a metal plate made of, for example, iron or stainless steel. The material and manufacturing method of the securing members 10 are not limited to those described above, and various material and manufacturing methods may be used as appropriate.

Figure 15:
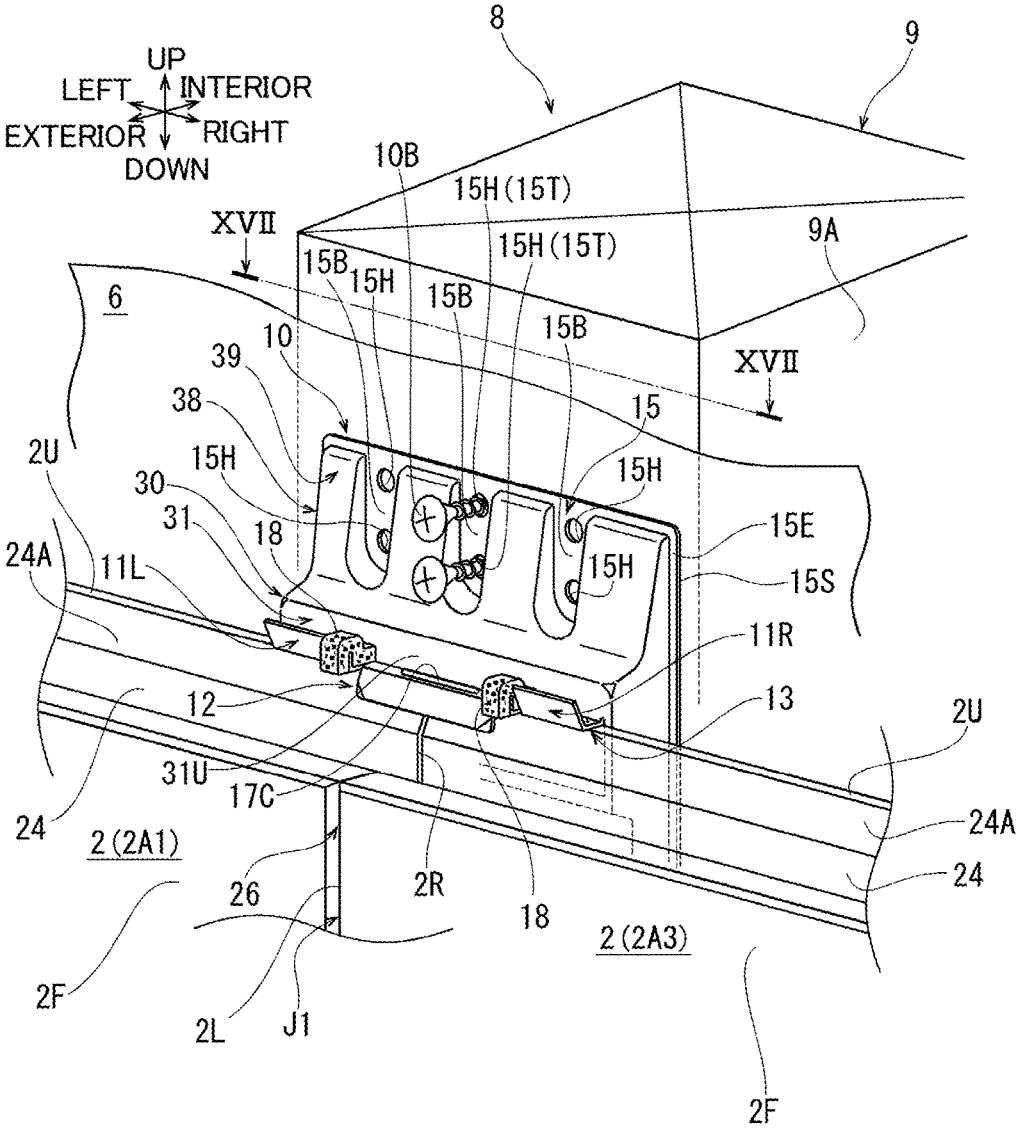
FIG. 15 is a partial perspective view illustrating the structure in which the first and third exterior wall plates are attached by using the securing member according to the first embodiment.
Figure 19:
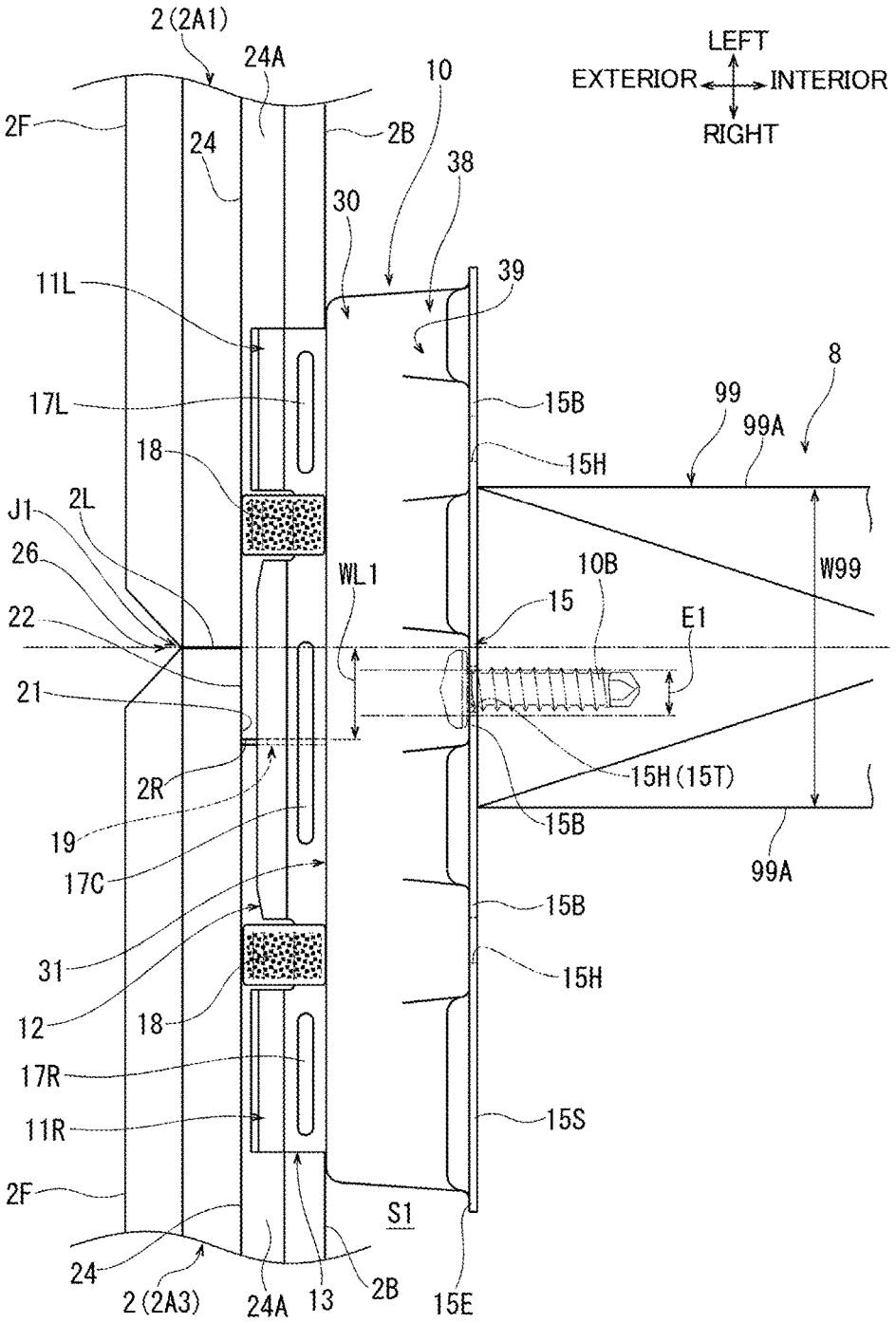
FIG. 19 is a partial sectional view similar to FIG. 17, illustrating the state in which the securing member is attached to a thin structural member.

As illustrated in, for example, FIG. 15, the securing member 10 is fixed to each column 9 with screws 10B, which serve as fasteners. Alternatively, as illustrated in FIG. 19, the securing member 10 is fixed to each thin structural member 99 with the screws 10B. However, the structure of the securing member 10 is not limited to this. The securing member 10 may instead be fixed to, for example, the column 9 or the like by using other fasteners, such as nails, or be fixed indirectly to the column 9 or the like with a support member 7 illustrated in FIG. 1 or the like interposed therebetween.

Figure 16:
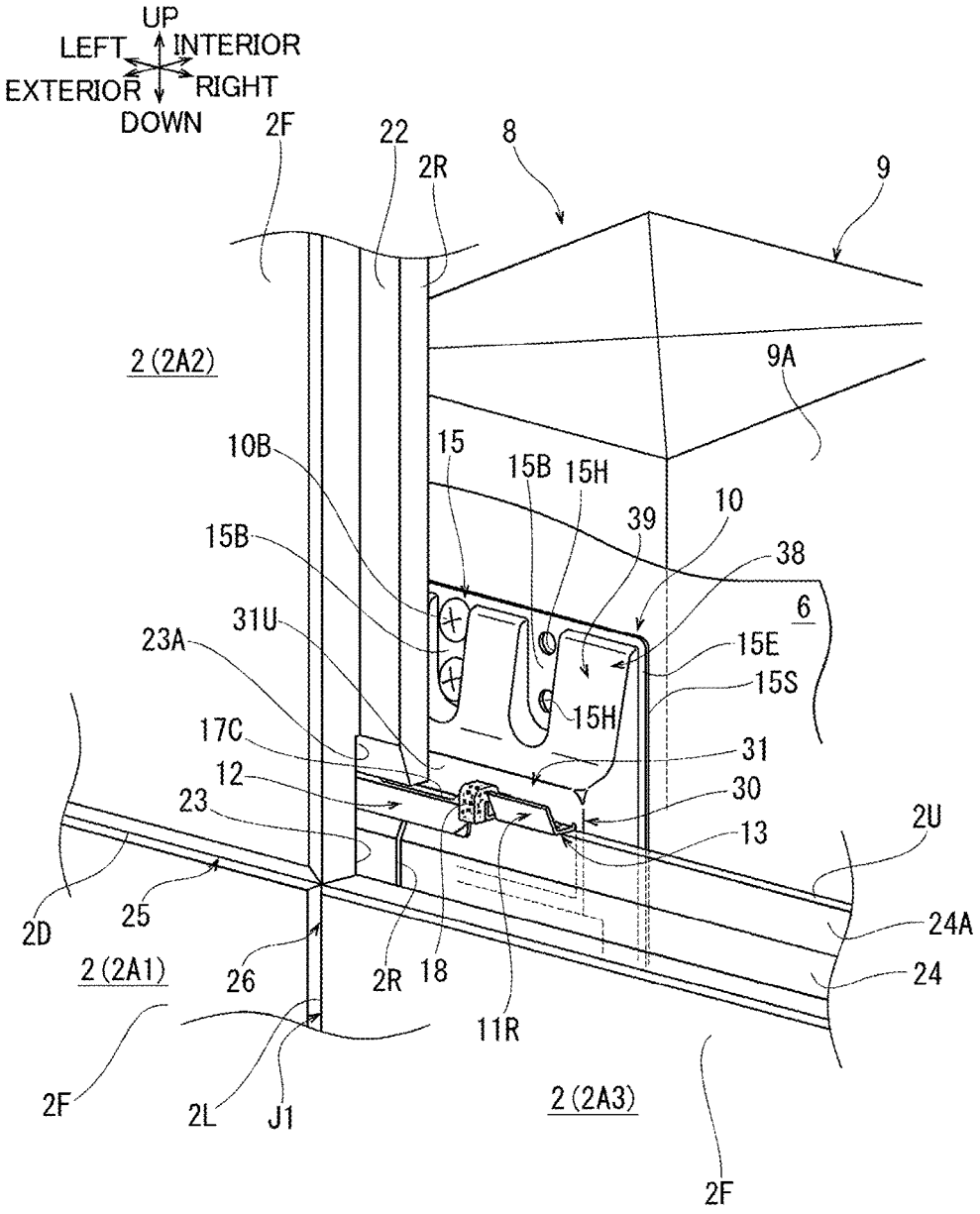
FIG. 16 is a partial perspective view illustrating the structure in which the first to third exterior wall plates are attached by using the securing member according to the first embodiment.

As illustrated in, for example, FIGS. 6 and 16, the standard orientation of each securing member 10 is the orientation in a fixed state in which a fixing portion 15 of the securing member 10 is fixed to the column 9 that constitutes the framework 8. More specifically, the front of the securing member 10 faces the exterior side, and the back of the securing member 10 faces the interior side. The width direction of the securing member 10 is the horizontal direction.

Figure 8:
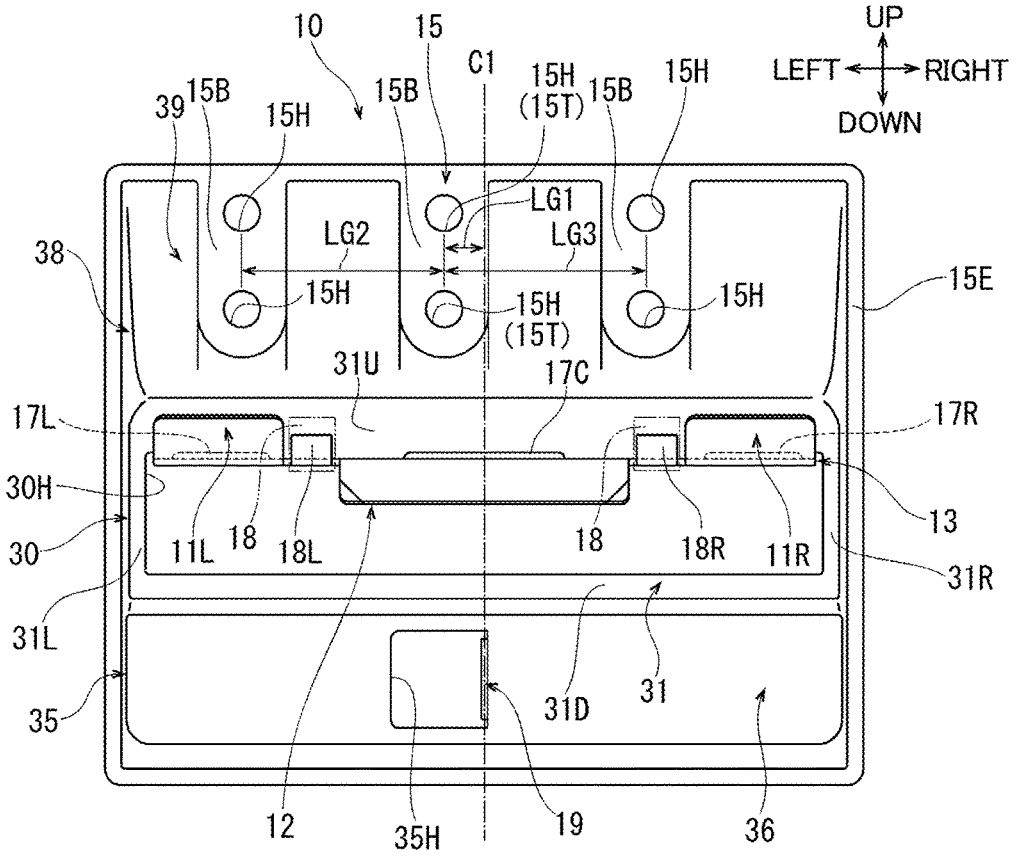
FIG. 8 is a front view of the securing member according to the first embodiment.

Each securing member 10 includes a pressed portion formed by pressing a metal plate, and a peripheral portion 15E of the fixing portion 15 that is flat and surrounds the pressed portion. As illustrated in FIG. 8, the peripheral portion 15E of the fixing portion 15 has a substantially rectangular shape that is symmetric about a center line C1 that extends in the vertical direction at the center of the fixing portion 15 in the width direction.

Figure 9:
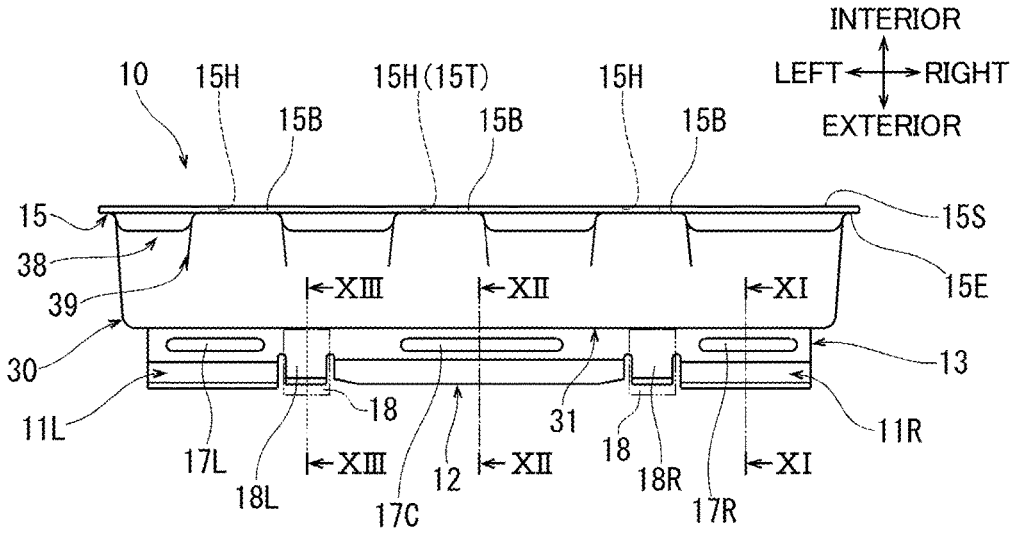
FIG. 9 is a top view of the securing member according to the first embodiment.
Figure 10:
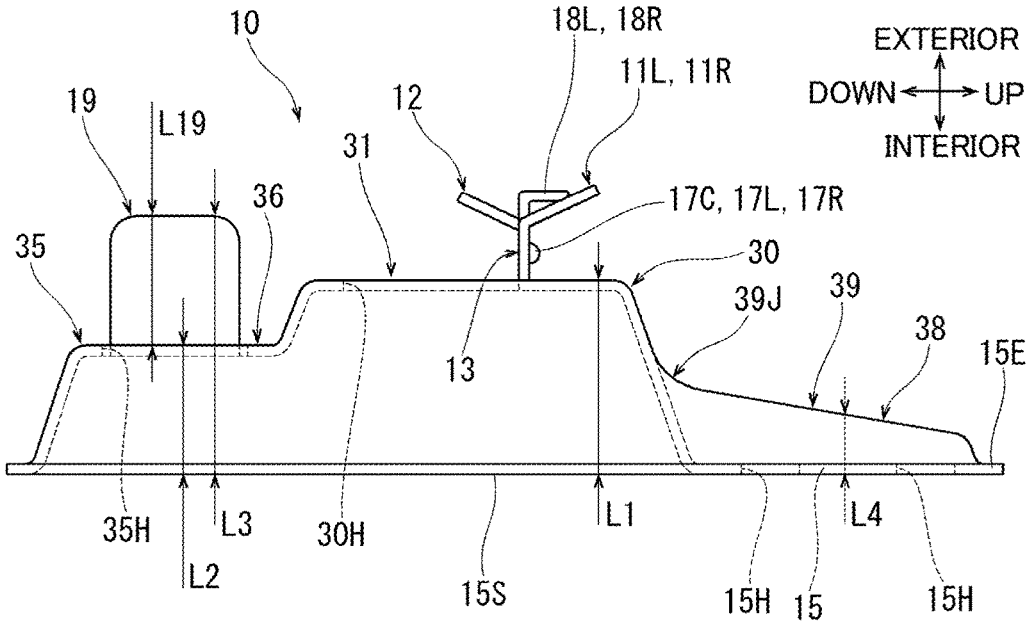
FIG. 10 is a side view of the securing member according to the first embodiment.

Referring to FIGS. 9 and 10, the back surface of the securing member 10 that is in contact with, for example, the column 9 serves as a reference surface 15S of the fixing portion 15. As illustrated in FIGS. 7 to 10, the fixing portion 15 also includes three U-shaped fixing portions 15B, which extend downward from the top side of the peripheral portion 15E of the fixing portion 15 along fixing holes 15H.

As illustrated in FIG. 8, the U-shaped fixing portions 15B are arranged with intervals therebetween in the width direction. The central U-shaped fixing portion 15B is displaced leftward from the center line C1. The left U-shaped fixing portion 15B is displaced leftward from the central U-shaped fixing portion 15B. The right U-shaped fixing portion 15B is displaced rightward from the center line C1.

Each U-shaped fixing portion 15B has two vertically arranged fixing holes 15H that extend through the U-shaped fixing portion 15B. The screws 10B are inserted through the fixing holes 15H to fix the securing member 10 to the column 9 or the like. The two fixing holes 15H formed in the central U-shaped fixing portion 15B are specific fixing holes 15T that are closest to the center line C1 among the fixing holes 15H. Each specific fixing hole 15T is displaced leftward from the center line C1.

The distance by which the specific fixing holes 15T are displaced from the center line C1 is denoted by LG1. The distance by which the two fixing holes 15H formed in the left U-shaped fixing portion 15B are separated from the specific fixing holes 15T in the width direction is denoted by LG2. The distance by which the two fixing holes 15H formed in the right U-shaped fixing portion 15B are separated from the specific fixing holes 15T in the width direction is denoted by LG3. The distances LG2 and LG3 are equal to each other. The distance by which the two fixing holes 15H formed in the left U-shaped fixing portion 15B are displaced leftward from the center line C1 is LG1+LG2. The distance by which the two fixing holes 15H formed in the right U-shaped fixing portion 15B are displaced rightward from the center line C1 is LG3-LG1. Thus, in the present embodiment, the fixing holes 15H are not symmetrical about the center line C1.

As illustrated in FIGS. 7 to 10, the pressed portion of the securing member 10 includes a main bulging portion 30, a lower bulging portion 35, and an upper bulging portion 38.

The main bulging portion 30 is disposed in a central region of the securing member 10 in the vertical direction, and bulges from the fixing portion 15 toward the front of the securing member 10. The main bulging portion 30 bulges toward the front beyond the lower bulging portion 35 and the upper bulging portion 38. The main bulging portion 30 includes a front end surface that extends parallel to the fixing portion 15. The front end surface of the main bulging portion 30 serves as a contact surface 31.

The lower bulging portion 35 bulges from the fixing portion 15 toward the front, and is adjacent to and below the main bulging portion 30. The lower bulging portion 35 includes a front end surface that is substantially parallel to the fixing portion 15. The front end surface of the lower bulging portion 35 serves as an erection surface 36. The upper edge of the erection surface 36 is connected to the lower surface of the main bulging portion 30.

The upper bulging portion 38 bulges from the fixing portion 15 toward the front, and is adjacent to and above the main bulging portion 30. The upper bulging portion 38 includes an inclined surface 39 and an upper surface that is bent along the upper section of the peripheral portion 15E and the U-shaped fixing portions 15B. The inclined surface 39 is pressed so as not to cover the U-shaped fixing portions 15B, so that the upper bulging portion 38 includes portions adjacent to the fixing holes 15H in the width direction. As illustrated in FIG. 10, the lower edge of the inclined surface 39 is connected to the upper surface of the main bulging portion 30, and a connecting portion 39J therebetween is gently curved.

As illustrated in FIGS. 7 to 10, the left and right surfaces of the main bulging portion 30, the lower bulging portion 35, and the upper bulging portion 38 are connected so as to be substantially flush with each other and form smooth continuous surfaces. The left and right surfaces of the main bulging portion 30, the lower bulging portion 35, and the upper bulging portion 38 are not limited to this, and may instead be connected to each other with steps therebetween.

Referring to FIG. 10, the first length L1 by which the front end of the main bulging portion 30 bulges from the reference surface 15S is the distance by which the contact surface 31 is separated from the reference surface 15S toward the front of the securing member 10. The second length L2 by which the front end of the lower bulging portion 35 bulges from the reference surface 15S is the distance by which the erection surface 36 is separated from the reference surface 15S toward the front of the securing member 10. In the present embodiment, the first length L1 is greater than second length L2. In addition, the second length L2 is greater than half the first length L1.

The upper bulging portion 38 is inclined such that the length L4 by which the upper bulging portion 38 bulges from the reference surface 15S toward the front increases toward the main bulging portion 30.

As illustrated in FIGS. 7 to 13, the main bulging portion 30 includes a first opening 30H, a supporting portion 13 that is raised at the periphery of the first opening 30H, upper engagement portions 11L and 11R that are connected to the front end of the supporting portion 13 so as to extend upward, and a lower engagement portion 12 that is connected to the front end of the supporting portion 13 so as to extend downward.

More specifically, a substantially U-shaped cut is formed in a central region of the contact surface 31 of the main bulging portion 30, and a plate-shaped portion surrounded by the substantially U-shaped cut is raised toward the front of the securing member 10. Thus, the first opening 30H, which has a substantially rectangular shape, is formed in the central region of the contact surface 31. The raised portion that projects from the contact surface 31 toward the front includes a part that extends substantially horizontally near the contact surface 31, and this part serves as the supporting portion 13. The upper engagement portions 11L and 11R are connected to left and right portions of the front edge of the supporting portion 13, and are bent upward. The lower engagement portion 12 is bent downward from the front edge of the supporting portion 13 in a central region in the width direction.

The contact surface 31 includes a pair of horizontally extending surfaces 31U and 31D and a pair of vertically extending surfaces 31L and 31R. The upper horizontally extending surface 31U is located above the upper engagement portions 11L and 11R and the lower engagement portion 12 and extends in the horizontal direction. The lower horizontally extending surface 31U is located below the upper engagement portions 11L and 11R and the lower engagement portion 12 and extends in the horizontal direction. The left vertically extending surface 31L, which is located on the left side of the upper engagement portion 11L and the lower engagement portion 12, extends in the vertical direction and is connected to the left ends of the pair of horizontally extending surfaces 31U and 31D. The right vertically extending surface 31R, which is located on the right side of the upper engagement portion 11R and the lower engagement portion 12, extends in the vertical direction and is connected to the right ends of the pair of horizontally extending surfaces 31U and 31D. Thus, the pair of horizontally extending surfaces 31U and 31D and the pair of vertically extending surfaces 31L and 31R form a loop.

Figure 7:
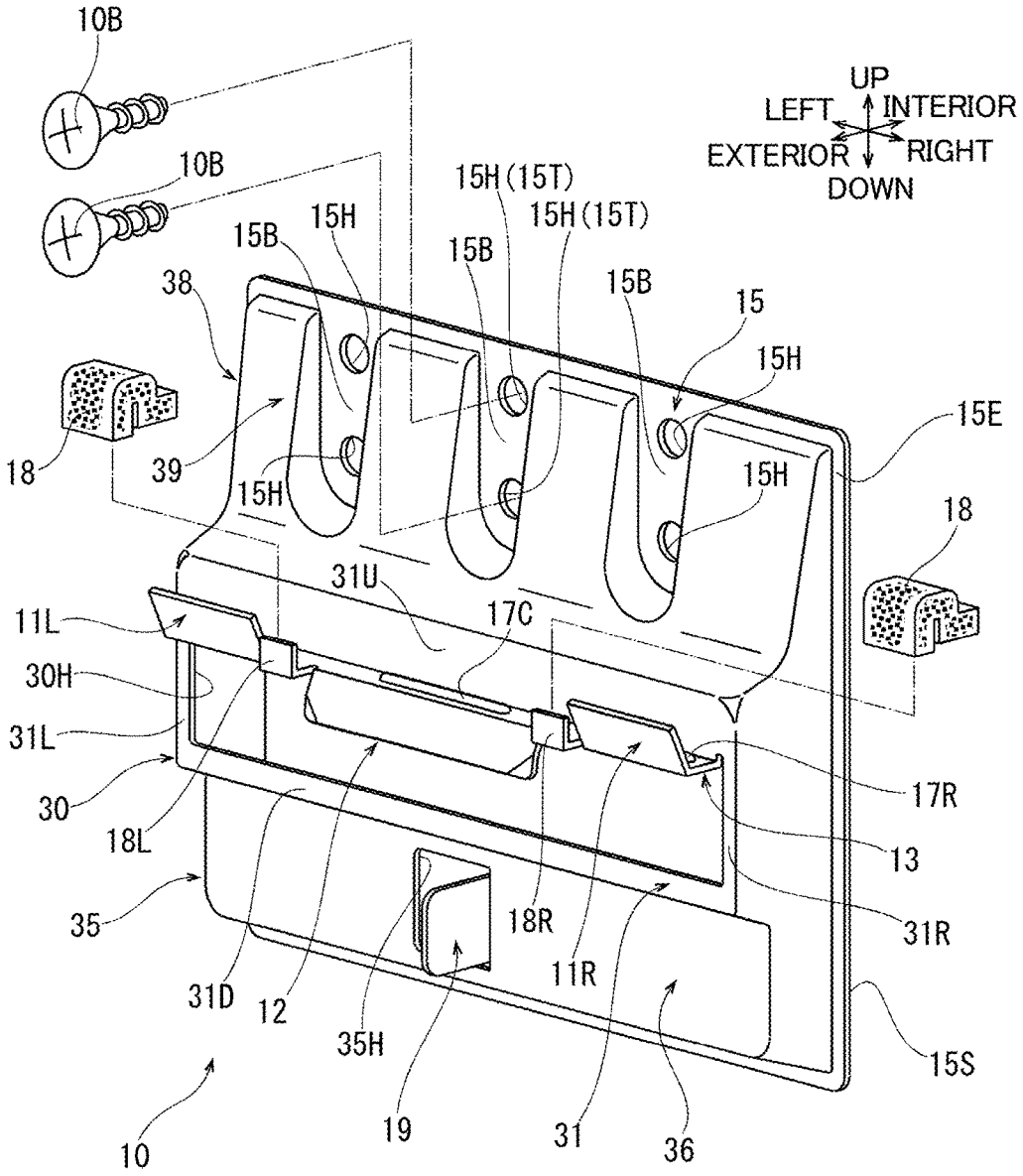
FIG. 7 is a perspective view of a securing member according to the first embodiment.

As illustrated in FIGS. 7, 8, and 10, the lower bulging portion 35 includes a second opening 35H and an erected portion 19 that is raised at the periphery of the second opening 35H. More specifically, a substantially C-shaped cut is formed in the erection surface 36 of the lower bulging portion 35 at a position somewhat displaced leftward from the center, and a plate-shaped portion surrounded by the substantially C-shaped cut is raised toward the front of the securing member 10. Thus, the second opening 35H, which has a substantially rectangular shape, is formed in the erection surface 36. The raised portion that projects forward from the erection surface 36 serves as the erected portion 19.

As illustrated in FIG. 8, the erected portion 19 is disposed on the center line C1 of the fixing portion 15 in the width direction. As illustrated in FIG. 10, the third length L3, which is the distance from the reference surface 15S to the front end of the erected portion 19, is greater than the first length L1.

Figure 11:
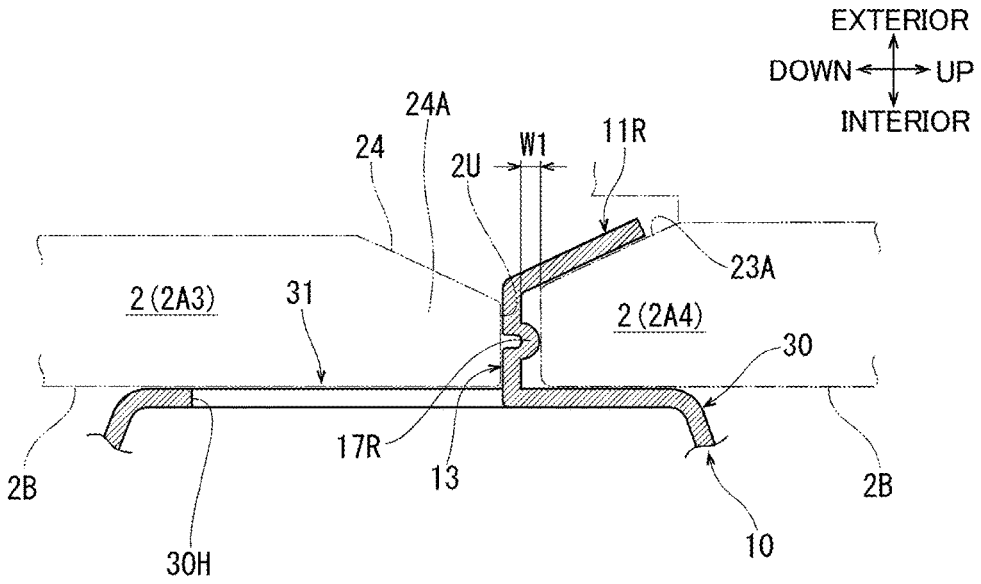
FIG. 11 is a partial sectional view taken along line XI-XI in FIG. 9.
Figure 12:
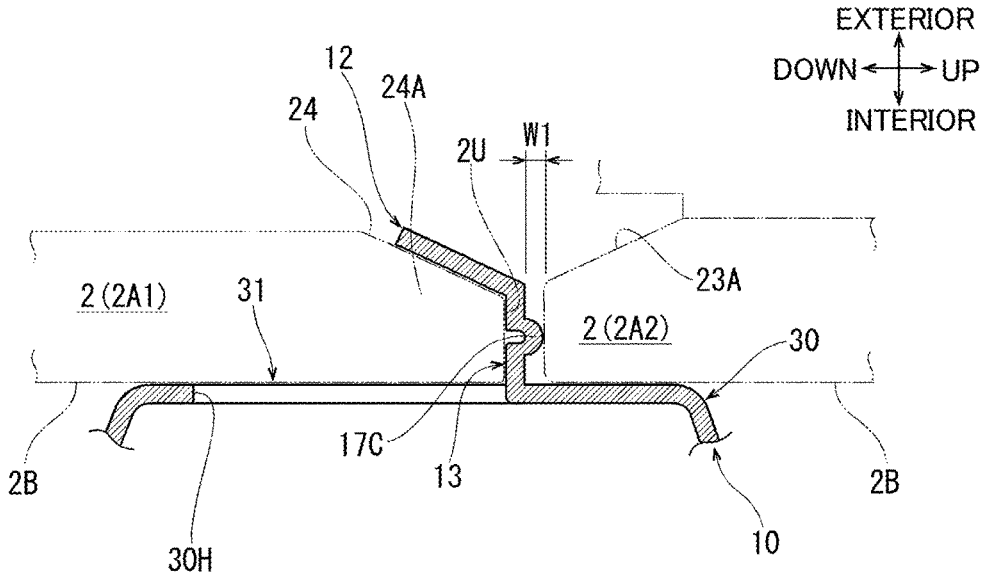
FIG. 12 is a partial sectional view taken along line XII-XII in FIG. 9.

As illustrated in FIGS. 7 to 12, projections 17C, 17L, and 17R project upward from the supporting portion 13. The projections 17C, 17L, and 17R linearly extend in the horizontal direction. As illustrated in FIGS. 11 and 12, the projections 17C, 17L, and 17R are substantially semicircular and project upward in cross section. Although FIGS. 11 and 12 do not illustrate the cross section of the projection 17L, the cross-sectional shape of the projection 17L is the same as those of the projections 17C and 17R. The cross-sectional shape of the projections 17C, 17L, and 17R is not limited to the above-described shape, and may instead be, for example, trapezoidal.

As illustrated in FIGS. 8 and 9, the central projection 17C is disposed at the center of the supporting portion 13 in the width direction, that is, on the center line C1. The left projection 17L is displaced leftward from the center of the supporting portion 13 in the width direction. The right projection 17R is displaced rightward from the center of the supporting portion 13 in the width direction.

As illustrated in FIGS. 9 to 12, the projections 17C, 17L, and 17R are located so as to be separated from the front end of the supporting portion 13 toward the contact surface 31, the front end being adjacent to the upper engagement portions 11L and 11R and the lower engagement portion 12. The projections 17C, 17L, and 17R are also located so as to be separated from the contact surface 31 toward the upper engagement portions 11L and 11R and the lower engagement portion 12. Accordingly, the projections 17C, 17L, and 17R are located so as to be separated from back surfaces 2B of a second exterior wall plate 2A2 and a fourth exterior wall plate 2A4 toward the front in a fixed state.

As illustrated in FIGS. 7 to 9 and 13, the supporting portion 13 includes holding portions 18L and 18R. The left holding portion 18L is a small upwardly bent portion disposed between the upper engagement portion 11L and the lower engagement portion 12. The right holding portion 18R is a small upwardly bent portion disposed between the upper engagement portion 11R and the lower engagement portion 12.

Figure 13:
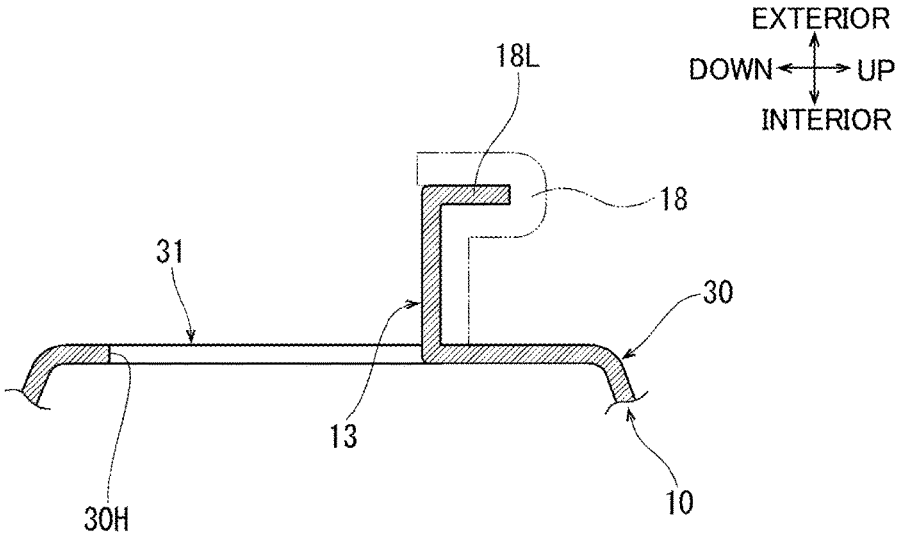
FIG. 13 is a partial sectional view taken along line XIII-XIII in FIG. 9.
Figure 17:
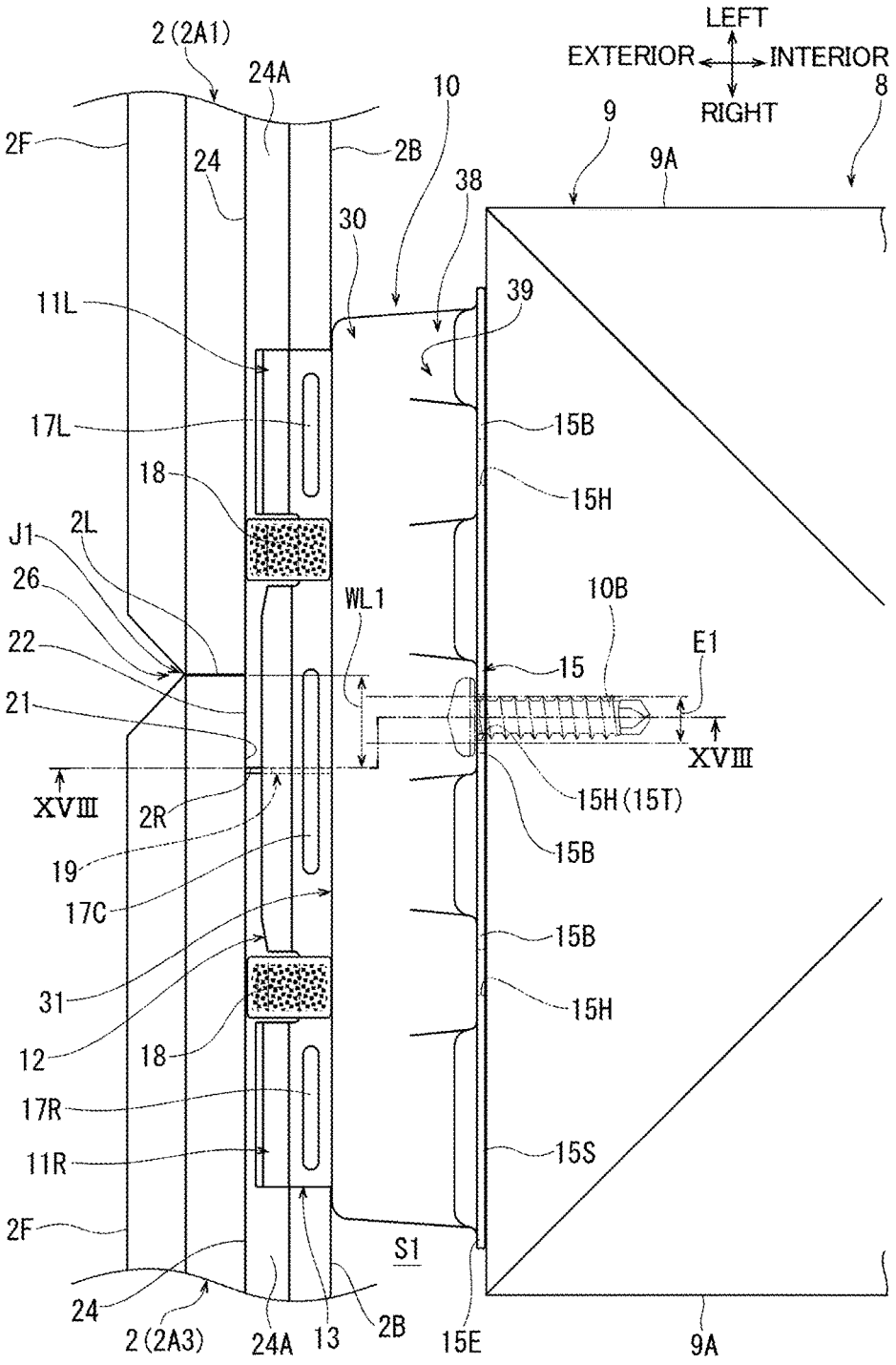
FIG. 17 is a partial sectional view taken along line XVII-XVII in FIG. 15.

Elastic members 18 are bonded to the holding portions 18L and 18R by using a double-side tape or the like. As illustrated in, for example, FIGS. 13 and 14, the elastic members 18 cover the holding portions 18L and 18R from the front of the securing member 10. As illustrated in FIGS. 13 and 17, the elastic members 18 are provided between the central projection 17C and the left projection 17L and between the central projection 17C and the right projection 17R so as to cover the holding portions 18L and 18R and partially cover the upper surface of the supporting portion 13. The elastic members 18 are in contact with the contact surface 31.

Figure 2:
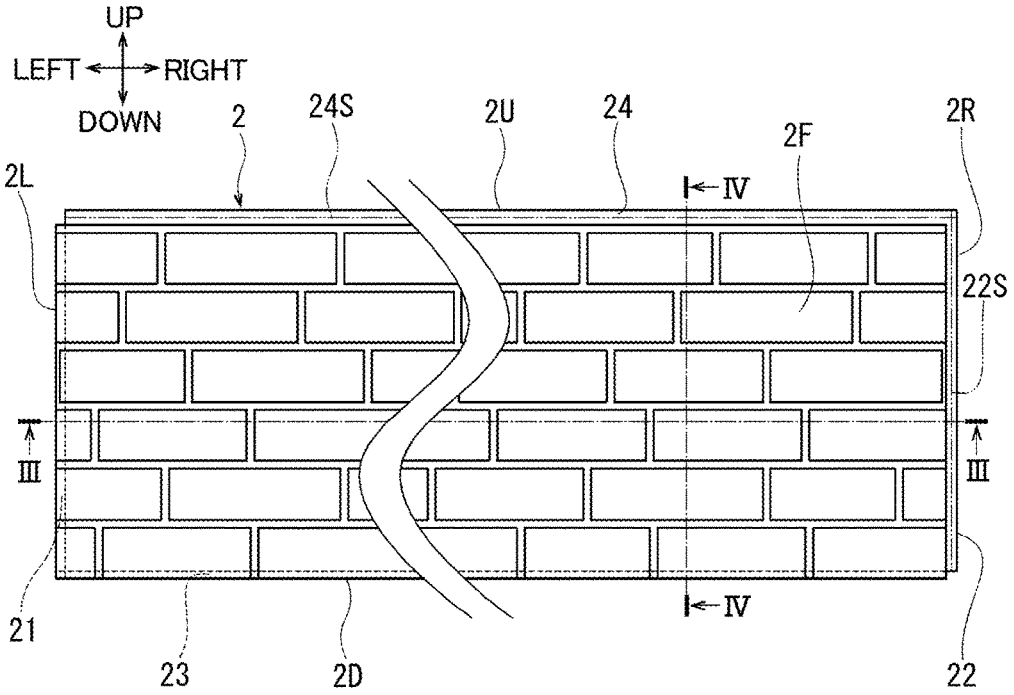
FIG. 2 is a front view of exterior wall plates (first to fourth exterior wall plates) according to the first embodiment.

As illustrated in, for example, FIGS. 1, 2, and 6, each exterior wall plate 2 is a quadrangular plate, more specifically, a substantially rectangular plate that is long in the horizontal direction. In the present embodiment, the exterior wall plates 2 are made of a ceramic material including cement. The material of the exterior wall plates 2 is not limited to the above-described material, and may instead be, for example, a metal material, a wood material, or a resin material as appropriate.

As illustrated in, for example, FIGS. 1, 6, and 16, the exterior wall plates 2 are disposed further toward the exterior side of the framework 8 than the waterproof sheet 6 and the support member 7 while being horizontally and vertically adjacent to each other. Thus, the exterior wall plates 2 cover an exterior surface 8F of the framework 8.

As illustrated in FIG. 2, a front surface 2F of the exterior wall plate 2 serves as an exterior surface having, for example, a brick pattern. A left end portion 2L of the exterior wall plate 2 includes a front horizontally joining portion 21. A right end portion 2R of the exterior wall plate 2 includes a back horizontally joining portion 22. A lower end portion 2D of the exterior wall plate 2 includes a front vertically joining portion 23. An upper end portion 2U of the exterior wall plate 2 includes a back vertically joining portion 24.

Figure 3:
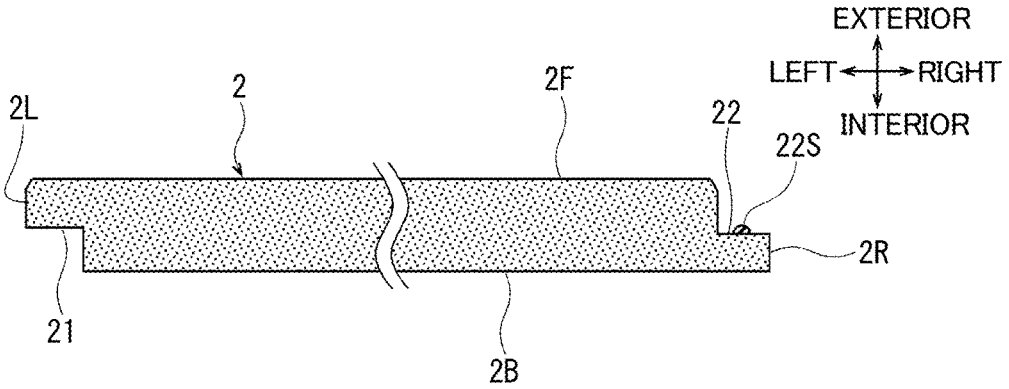
FIG. 3 is a partial sectional view taken along line in FIG. 2.
Figure 5:
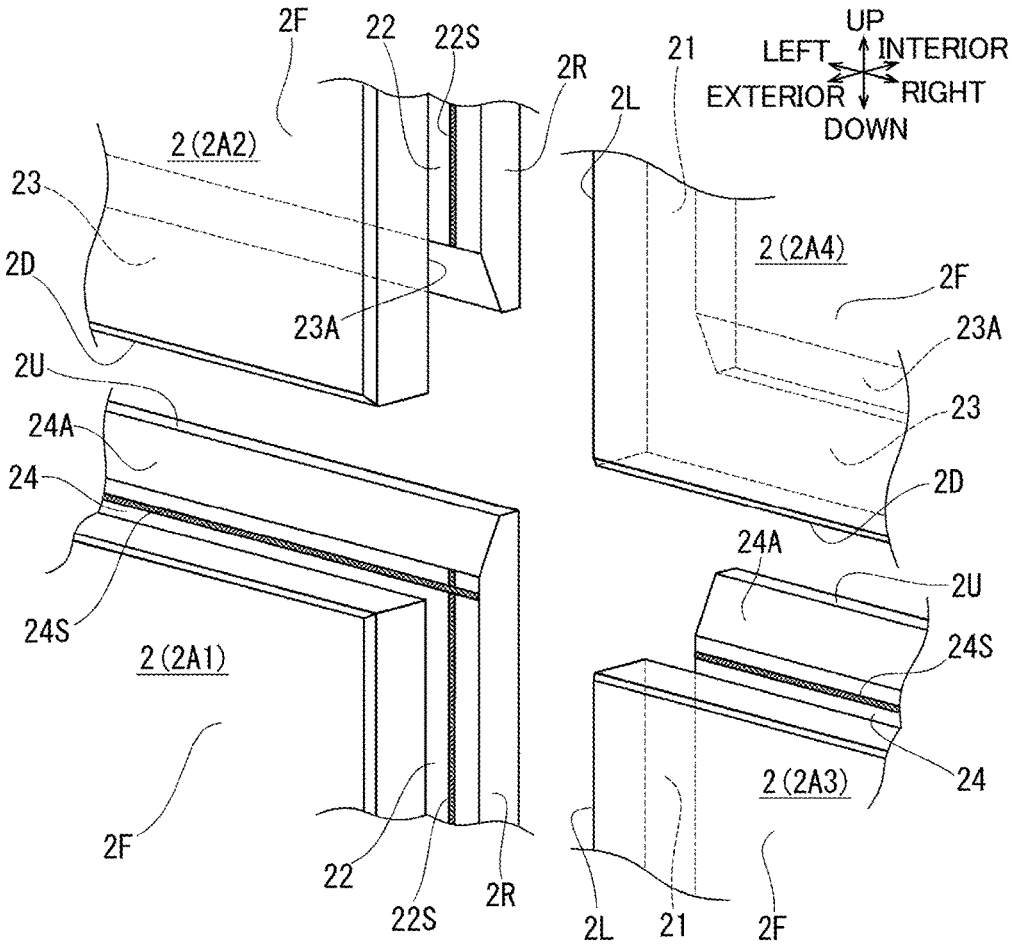
FIG. 5 is a partial perspective view illustrating the structure in which the first to fourth exterior wall plates, which are adjacent to each other, are assembled in the first embodiment.

As illustrated in FIGS. 3 and 5, the front horizontally joining portion 21 is recessed stepwise from the back surface 2B of the exterior wall plate 2 toward the front surface 2F, and extends in the vertical direction, that is, along the left end portion 2L.

The back horizontally joining portion 22 is recessed stepwise from the front surface 2F of the exterior wall plate 2 toward the back surface 2B, and extends in the vertical direction, that is, along the right end portion 2R. A flat surface of the back horizontally joining portion 22 that faces the exterior side has a caulking material 22S provided thereon. The caulking material 22S extends linearly along the back horizontally joining portion 22. The caulking material is not essential, and the caulking material 22S of the present embodiment may be omitted.

Figure 4:
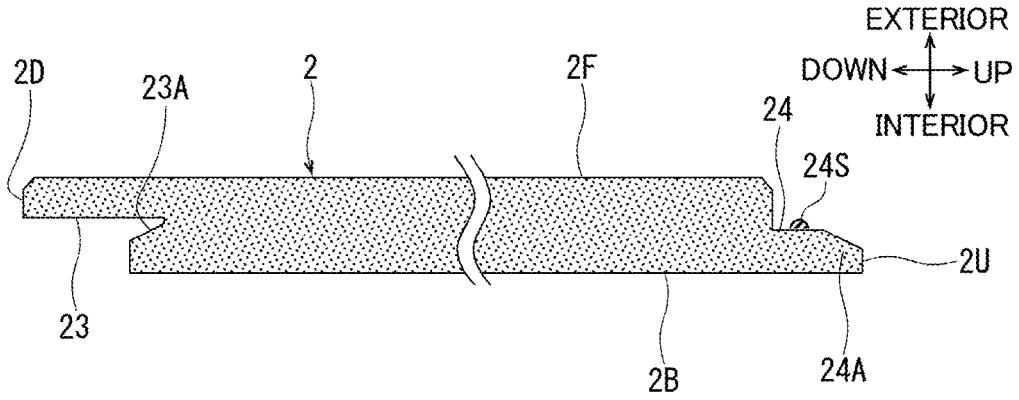
FIG. 4 is a partial sectional view taken along line IV-IV in FIG. 2.

As illustrated in FIGS. 4 and 5, the front vertically joining portion 23 is recessed stepwise from the back surface 2B of the exterior wall plate 2 toward the front surface 2F, and extends in the horizontal direction, that is, along the lower end portion 2D. The front vertically joining portion 23 includes an engagement recess 23A that is substantially upwardly tapered.

The back vertically joining portion 24 is recessed stepwise from the front surface 2F of the exterior wall plate 2 toward the back surface 2B, and extends in the horizontal direction, that is, along the upper end portion 2U. A flat surface of the back vertically joining portion 24 that faces the exterior side has a caulking material 24S provided thereon. The caulking material 24S extends linearly along the back vertically joining portion 24. The caulking material is not essential, and the caulking material 24S of the present embodiment may be omitted. The back vertically joining portion 24 includes an engagement projection 24A that is located above the caulking material 24S and that is substantially upwardly tapered.

Figure 18:
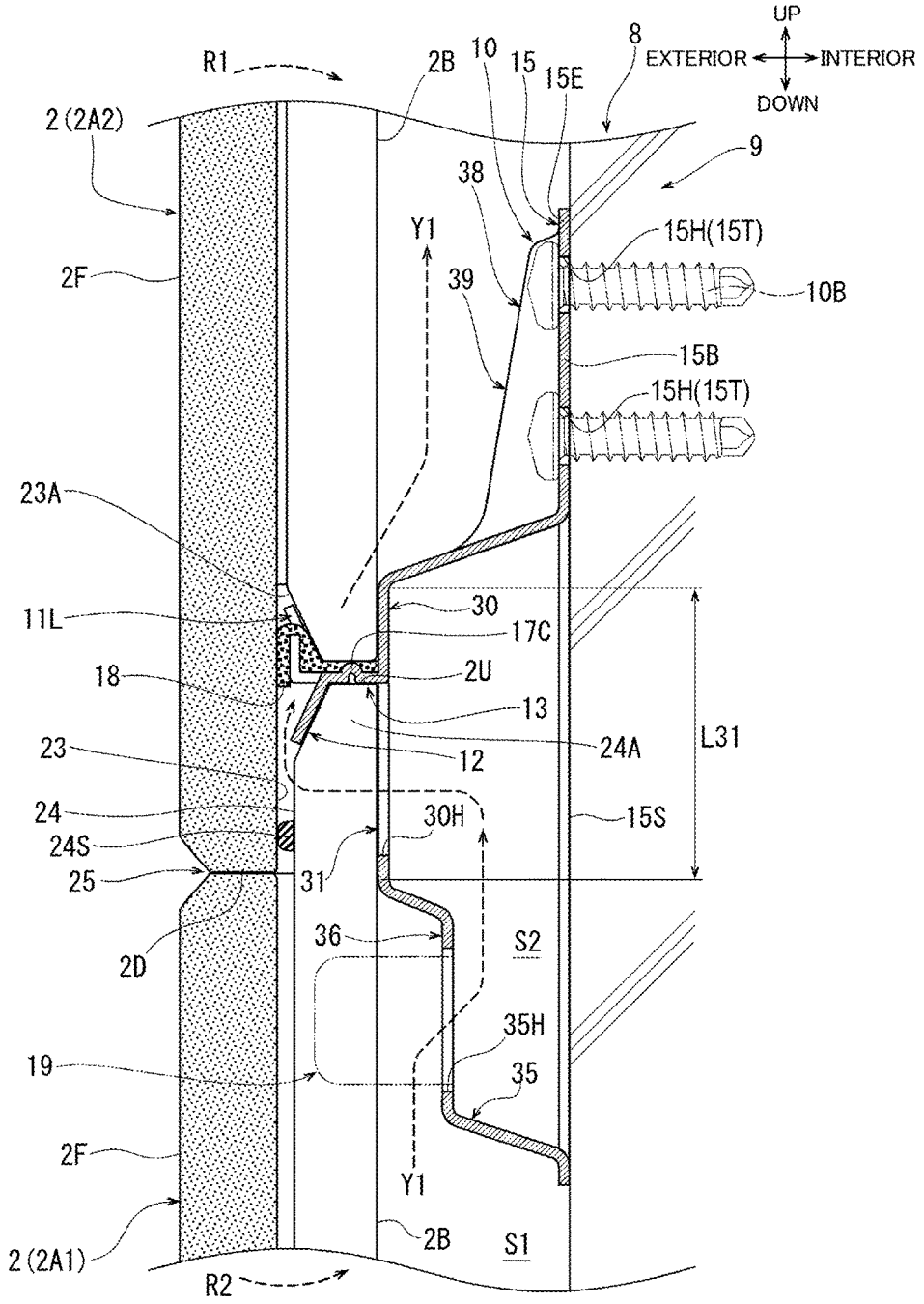
FIG. 18 is a partial sectional view taken along line XVIII-XVIII in FIG. 17.

As illustrated in FIGS. 6 and 14 to 17, a horizontally joining portion 26 is formed between horizontally adjacent exterior wall plates 2 by stacking the front horizontally joining portion 21 of one of the exterior wall plates 2 and the back horizontally joining portion 22 of the other exterior wall plate 2 together. As illustrated in FIGS. 6, 16, and 18, a vertically joining portion 25 is formed between vertically adjacent exterior wall plates 2 by stacking the front vertically joining portion 23 of one of the exterior wall plates 2 and the back vertically joining portion 24 of the other exterior wall plate 2 together. More specifically, each exterior wall plate 2 has a so-called "four-side shiplap structure" including the front horizontally joining portion 21, the back horizontally joining portion 22, the front vertically joining portion 23, and the back vertically joining portion 24. The front horizontally joining portion 21 of an exterior wall plate 2 and the back horizontally joining portion 22 of another exterior wall plate 2 are stacked together to form the horizontally joining portion 26, and the front vertically joining portion 23 of an exterior wall plate 2 and the back vertically joining portion 24 of another exterior wall plate 2 are stacked together to form the vertically joining portion 25.

Referring to FIGS. 6 and 17, WL1 denotes the overlapping width of the back horizontally joining portion 22 and the front horizontally joining portion 21. The distance LG1 illustrated in FIG. 8 is greater than or equal to ¼ of the overlapping width WL1, and less than or equal to ¾ of the overlapping width WL1. In FIG. 17, E1 denotes the range in which the distance LG1 is greater than or equal to ¼ of the overlapping width WL1 of the back horizontally joining portion 22 and the front horizontally joining portion 21 and less than or equal to ¾ of the overlapping width WL1.

Referring to FIGS. 5, 6, and 14 to 18, any one of the exterior wall plates 2 is defined as a first exterior wall plate 2A1, and three exterior wall plates 2 having the following relationships with the first exterior wall plate 2A1 are defined as a second exterior wall plate 2A2, a third exterior wall plate 2A3, and a fourth exterior wall plate 2A4. The second exterior wall plate 2A2 is adjacent to and above the first exterior wall plate 2A1. The third exterior wall plate 2A3 is adjacent to the first exterior wall plate 2A1 at the right side of the first exterior wall plate 2A1. The fourth exterior wall plate 2A4 is adjacent to and above the third exterior wall plate 2A3 and is adjacent to the second exterior wall plate 2A2 at the right side of the second exterior wall plate 2A2.

The exterior wall plates 2 having the above-described structure are supported by the securing members 10 in the following manner.

As illustrated in FIG. 1, first, a plurality of exterior wall plates 2 are attached to the bottom of the exterior surface 8F of the framework 8 so as to be horizontally adjacent to each other. At this time, the lower end portions 2D of the exterior wall plates 2 are engaged with a bottom support member 55 disposed at the bottom of the exterior surface 8F of the framework 8 so as to extend in the horizontal direction. Assume that two of the exterior wall plates 2 that are horizontally adjacent to each other are the first exterior wall plate 2A1 and the third exterior wall plate 2A3.

Figure 14:
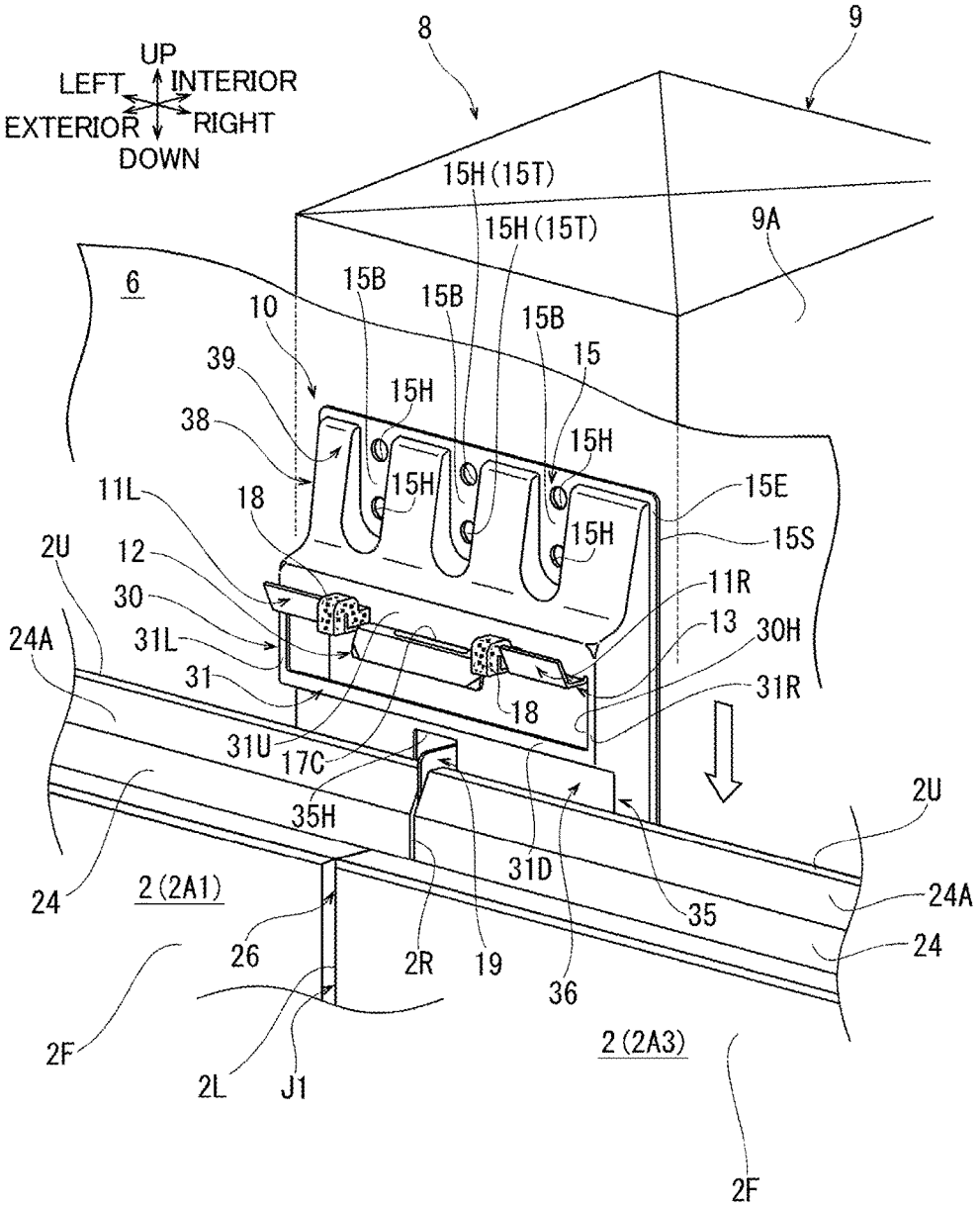
FIG. 14 is a partial perspective view illustrating a method for positioning the securing member and the first and third exterior wall plates according to the first embodiment.

Next, as illustrated in FIG. 14, the securing member 10 is moved downward while the reference surface 15S thereof is in contact with the column 9, and the erected portion 19 of the securing member 10 is inserted into the horizontally joining portion 26 of the first and third exterior wall plates 2A1 and 2A3 from above. Then, as illustrated in FIGS. 15 and 17, the screws 10B are inserted through the fixing holes 15H in one of the U-shaped fixing portions 15B and screwed into the column 9, so that the securing member 10 is fixed to the column 9. Owing to the upper bulging portion 38, the head portions of the screws 10B do not project toward the front of the securing member 10.

As a result, the engagement projections 24A of the back vertically joining portions 24 of the first and third exterior wall plates 2A1 and 2A3 are retained by the lower engagement portion 12 of the securing member 10. In addition, the back surfaces 2B of the first and third exterior wall plates 2A1 and 2A3 are supported by the contact surface 31 of the securing member 10, more specifically, by the lower horizontally extending surface 31D and lower portions of the left and right vertically extending surfaces 31L and 31R. Thus, the first and third exterior wall plates 2A1 and 2A3 are prevented from being displaced toward the interior side. As a result, as illustrated in FIGS. 17 and 18, a ventilation space S1 is provided between the framework 8 and the back surfaces 2B of the first and third exterior wall plates 2A1 and 2A3.

Thus, the securing member 10 supports the upper end portions 2U of the first and third exterior wall plates 2A1 and 2A3 in the fixed state. In the fixed state, the erected portion 19 of the securing member 10 is disposed between the end portions of the first and third exterior wall plates 2A1 and 2A3 that oppose each other in the horizontal direction, thereby preventing sideways displacement of the first and third exterior wall plates 2A1 and 2A3. As illustrated in FIG. 17, the back horizontally joining portion 22 of the first exterior wall plate 2A1 and the front horizontally joining portion 21 of the third exterior wall plate 2A3 overlap at a position displaced leftward from the erected portion 19, which is disposed on the center line C1 of the fixing portion 15.

Next, as illustrated in FIGS. 16 and 18, the second and fourth exterior wall plates 2A2 and 2A4 are attached above the first and third exterior wall plates 2A1 and 2A3 so as to be horizontally adjacent to each other.

Accordingly, the engagement recesses 23A in the front vertically joining portions 23 of the second and fourth exterior wall plates 2A2 and 2A4 are engaged with the upper engagement portions 11L and 11R of the securing member 10.

At this time, as illustrated in FIGS. 11, 12, 16, and 18, the projections 17C, 17L, and 17R come into contact with end surfaces of the second and fourth exterior wall plates 2A2 and 2A4 from below, thereby forming a gap W1 illustrated in FIGS. 11 and 12 between the supporting portion 13 and the second and fourth exterior wall plates 2A2 and 2A4. The area in which the projections 17C, 17L, and 17R come into contact with the end surfaces of the second and fourth exterior wall plates 2A2 and 2A4 is smaller than the area in which the supporting portion 13 will come into contact with the end surfaces of the second and fourth exterior wall plates 2A2 and 2A4 if the projections 17C, 17L, and 17R are not provided. Therefore, the risk that rainwater that has accumulated on the supporting portion 13 or rainwater that has been absorbed by dust, dirt, or the like on the supporting portion 13 will be in contact with the end surfaces of the second and fourth exterior wall plates 2A2 and 2A4 for a long time can be reduced, and the second and fourth exterior wall plates 2A2 and 2A4 can be prevented from being damaged by being soaked with the rainwater or the like.

As illustrated in FIG. 18, the elastic member 18 that is adjacent to the upper engagement portion 11L comes into contact with the bottom end of the second exterior wall plate 2A2, thereby being compressed and deformed. Although not illustrated, the elastic member 18 that is adjacent to the upper engagement portion 11R also comes into contact with the bottom end of the fourth exterior wall plate 2A4, thereby being compressed and deformed. The left and right elastic members 18 seal the space between the second exterior wall plate 2A2 and the supporting portion 13 and the space between the fourth exterior wall plate 2A4 and the supporting portion 13.

The back surfaces 2B of the second and fourth exterior wall plates 2A2 and 2A4 are supported by the contact surface 31 of the securing member 10, more specifically, by the upper horizontally extending surface 31U and upper portions of the left and right vertically extending surfaces 31L and 31R. Thus, the second and fourth exterior wall plates 2A2 and 2A4 are prevented from being displaced toward the interior side. As a result, the ventilation space S1 is provided between the framework 8 and the back surfaces 2B of the second and fourth exterior wall plates 2A2 and 2A4.

FIGS. 15 to 18 illustrate an example in which the securing member 10 is fixed to the column 9 by inserting the screws 10B through the specific fixing holes 15T and screwing the screws 10B into the column 9. However, since the width of the column 9 is greater than the width of the securing member 10, the securing member 10 may also be fixed to the column 9 by inserting the screws 10B through other fixing holes 15H.

As illustrated in FIG. 19, the securing member 10 may instead be fixed to a thin structural member 99. When the width W99 of the thin structural member 99 is close to the distance LG2+LG3 illustrated in FIG. 8 or is less than or equal to the distance LG2+LG3, the fixing holes 15H other than the specific fixing holes 15T easily protrude from the thin structural member 99. Therefore, only the specific fixing holes 15T are used to fix the securing member 10 to the thin structural member 99.

Referring to FIG. 19, to improve the construction quality, the securing member 10 is preferably fixed to the thin structural member 99 so that the abutting line J1 between the front surfaces 2F of the first and third exterior wall plates 2A1 and 2A3 is at the center of the thin structural member 99. As illustrated in FIG. 8, the specific fixing holes 15T are displaced leftward from the center line C1 by the distance LG1 ($WL1\times\frac{1}{4}\leq LG1\leq WL1\times\frac{3}{4}$), and the erected portion 19 is disposed on the center line C1. Therefore, when the securing member 10 is fixed to the thin structural member 99 in the above-described manner, the specific fixing holes 15T are disposed near the center of the thin structural member 99, and are not easily disposed near either side surface 99A of the thin structural member 99.

Thus, the securing member 10 supports the second and fourth exterior wall plates 2A2 and 2A4 in the fixed state.

Although not illustrated, the upper end portions 2U of the second and fourth exterior wall plates 2A2 and 2A4 are supported on, for example, the column 9 by another securing member 10 in the above-described manner. The above-described process is performed on other exterior wall plates 2 so that the exterior wall plates 2 are supported on, for example, the columns 9 while being horizontally and vertically adjacent to each other. Thus, the exterior wall plates 2 cover the exterior surface 8F of the framework 8.

In FIG. 6, an additional securing member may be disposed between any two securing members 10 that are horizontally adjacent to each other. In such a case, the vertically joining portions 25 of the exterior wall plates 2 that are vertically adjacent to each other (the vertically joining portion 25 of the first and second exterior wall plates 2A1 and 2A2 and the vertically joining portion 25 of the third and fourth exterior wall plates 2A3 and 2A4) can be more securely supported.

First Operational Effect

In the securing member 10 according to the first embodiment, as illustrated in, for example, FIGS. 8 and 17, the erected portion 19 is disposed on the center line C1 of the fixing portion 15 in the width direction. Therefore, when the supporting portion 13, the upper engagement portions 11L and 11R, and the lower engagement portion 12 support the load of the first to fourth exterior wall plates 2A1 to 2A4, the length over which the first and second exterior wall plates 2A1 and 2A2 disposed at one side in the width direction are supported is equal to the length over which the third and fourth exterior wall plates 2A3 and 2A4 disposed at the other side in the width direction is supported. Thus, the load is balanced between one and the other sides in the width direction.

In this securing member 10, as illustrated in, for example, FIG. 8, the two specific fixing holes 15T that are closest to the center line C1 among the fixing holes 15H are displaced leftward from the erected portion 19 disposed on the center line C1 of the fixing portion 15. Therefore, as illustrated in FIG. 19, even when the securing member 10 is fixed to the thin structural member 99 so that the abutting line J1 between the front surfaces 2F of the first and third exterior wall plates 2A1 and 2A3 is near the center of the thin structural member 99, the specific fixing holes 15T are not easily disposed near either side surface 99A of the thin structural member 99. As a result, the risk that the screws 10B inserted through the specific fixing holes 15T will protrude from a side surface 99A of the thin structural member 99 and the risk that the side surface 99A of the thin structural member 99 will break can be reduced. In addition, as illustrated in, for example, FIG. 8, similar to the specific fixing holes 15T, the fixing holes 15H other than the specific fixing holes 15T are also displaced from the center line C1 in the width direction. Therefore, as illustrated in FIG. 17, even when the securing member 10 is fixed to the column 9 so that the abutting line J1 between the front surfaces 2F of the first and third exterior wall plates 2A1 and 2A3 is near the center of the column 9, the fixing holes 15H are not easily disposed near either side surface 9A of the column 9. As a result, the risk that the screws 10B inserted through the fixing holes 15H will protrude from a side surface 9A or 99A of the column 9 or thin structural member 99 and the risk that the side surface 9A or 99A of the column 9 or thin structural member 99 will break can be reduced.

Figure 20:
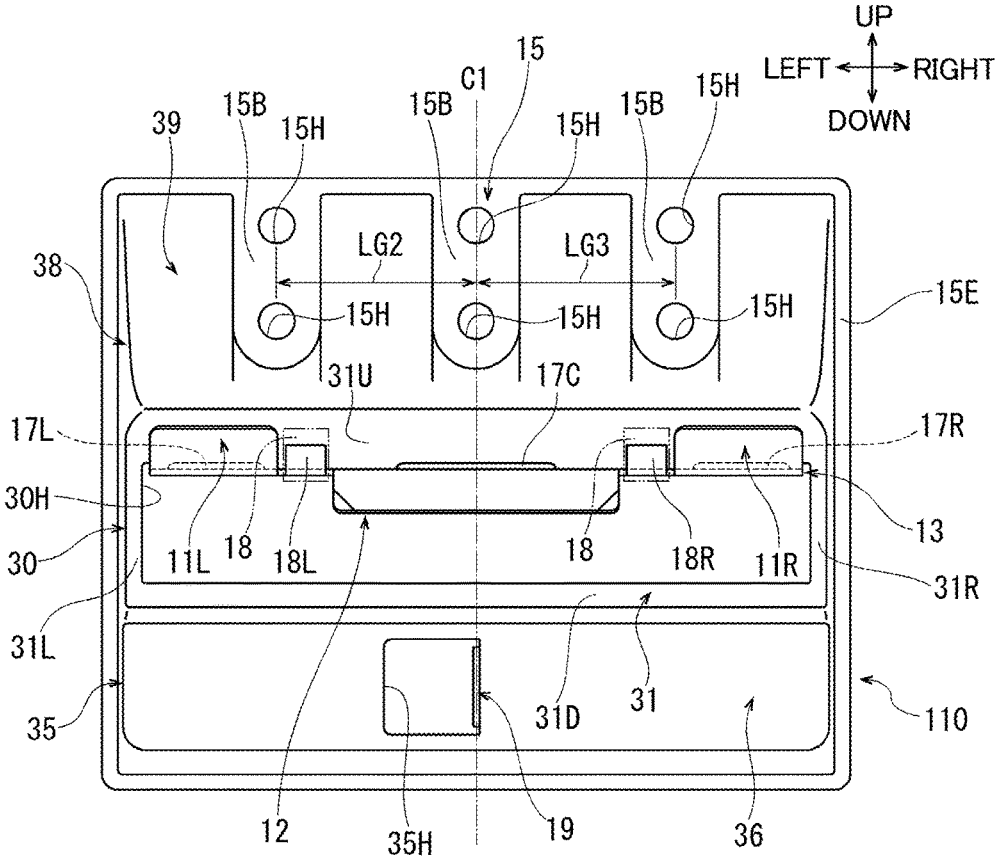
FIG. 20 is a front view of a securing member according to a comparative example.
Figure 21:
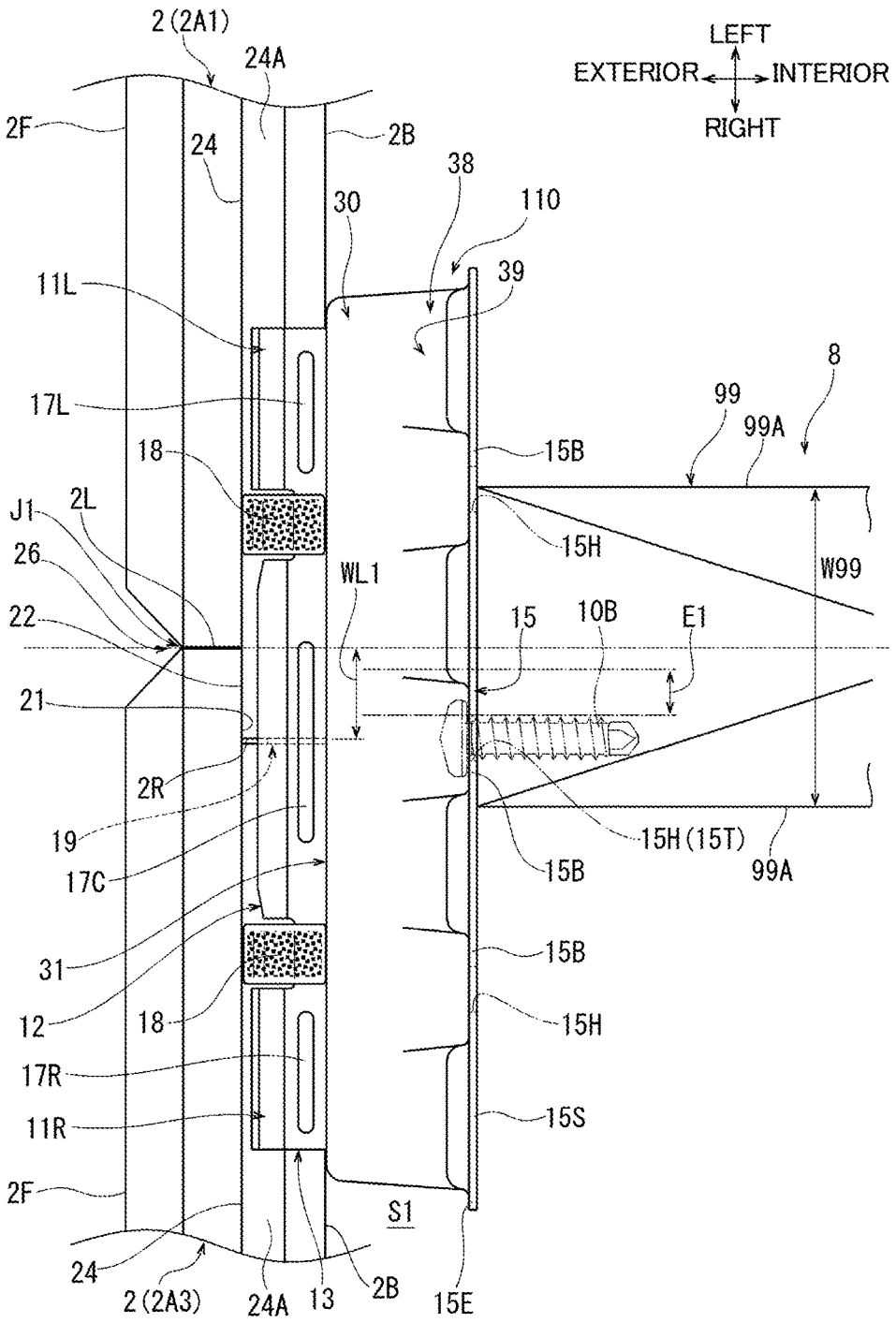
FIG. 21 is a partial sectional view similar to FIG. 19 according to the comparative example.

FIGS. 20 and 21 illustrate a securing member according to a comparative example. In the securing member according to the comparative example, a central U-shaped fixing portion 15B is on the center line C1. A left U-shaped fixing portion 15B is displaced leftward from the center line C1. A right U-shaped fixing portion 15B is displaced rightward from the center line C1.

Two fixing holes 15H formed in the central U-shaped fixing portion 15B are disposed on the center line C1. The distance by which two fixing holes 15H formed in the left U-shaped fixing portion 15B are displaced leftward from the center line C1 is denoted by LG2. The distance by which two fixing holes 15H formed in the right U-shaped fixing portion 15B are displaced rightward from the center line C1 is denoted by LG3 (=LG2). Thus, in the comparative example, the specific fixing holes 15T according to the first embodiment are not provided, and the fixing holes 15H are arranged symmetrically about the center line C1.

Other structures of the comparative example are similar to those of the first embodiment. Therefore, components that are the same as those in the first embodiment are denoted by the same reference numerals, and description thereof is omitted.

As illustrated in FIG. 21, in the case where the securing member 110 according to the comparative example is fixed to the thin structural member 99, if the securing member 110 is fixed to the thin structural member 99 so that the abutting line J1 between the front surfaces 2F of the first and third exterior wall plates 2A1 and 2A3 is near the center of the thin structural member 99, the two fixing holes 15H at the center will be disposed near one side surface 99A of the thin structural member 99. As a result, there is a risk that the screws 10B inserted through the two fixing holes 15H at the center will project from the side surface 99A of the thin structural member 99. There is also a risk that the side surface 99A of the thin structural member 99 will break.

In contrast, the securing member 10 according to the embodiment is capable of supporting the load of the exterior wall plates 2 with good balance in the width direction, and provides good construction performance even when the securing member 10 is fixed to the thin structural member 99.

As illustrated in FIGS. 17 and 19, the back horizontally joining portion 22 of the first exterior wall plate 2A1 and the front horizontally joining portion 21 of the third exterior wall plate 2A3 overlap at a position displaced leftward from the erected portion 19, which is disposed on the center line C1 of the fixing portion 15. In other words, the specific fixing holes 15T, which are displaced leftward from the center line C1, are disposed within a range in which the back horizontally joining portion 22 and the front horizontally joining portion 21 overlap or at a position near the range. Accordingly, as illustrated in FIG. 19, in the case where the securing member 10 is fixed to the thin structural member 99, even when the securing member 10 is fixed to the thin structural member 99 so that the abutting line J1 between the front surfaces 2F of the first and third exterior wall plates 2A1 and 2A3 is near the center of the thin structural member 99, the specific fixing holes 15T are not easily disposed near either side surface 99A of the thin structural member 99. As a result, the securing member 10 provides higher construction performance.

In the securing member 10, the distance LG1 illustrated in FIG. 8 by which the specific fixing holes 15T are displaced from the center line C1 is greater than or equal to ¼ of the overlapping width WL1 of the back horizontally joining portion 22 and the front horizontally joining portion 21 illustrated in FIGS. 17 and 19, and less than or equal to ¾ of the overlapping width WL1. Accordingly, in the securing member 10, the specific fixing holes 15T are disposed within the range E1 illustrated in FIGS. 17 and 19. As a result, the risk that the specific fixing holes 15T will be disposed near one side surface 99A of the thin structural member 99 can be further reduced, and the construction performance can be further improved. In the comparative example illustrated in FIG. 21, the two fixing holes 15H at the center are outside the range E1, and therefore are easily disposed near one side surface 99A of the thin structural member 99. Although not illustrated, the securing member 10 may instead be fixed to the thin structural member 99 so that the erected portion 19 between the back surfaces 2B of the first and third exterior wall plates 2A1 and 2A3 is near the center of the thin structural member 99. Also in this case, since $WL1 \times 1/4 \leq LG1 \leq WL1 \times 3/4$ is satisfied, the specific fixing holes 15T are not easily disposed near the other side surface 99A of the thin structural member 99.

As illustrated in, for example, FIGS. 8 and 19, the securing member 10 is fixed by using a plurality of screws 10B inserted through the specific fixing holes 15T that are arranged in the vertical direction. Therefore, the securing member 10 can be securely fixed to the thin structural member 99. In particular, the securing member 10 can be prevented from rotating.

Second Operational Effect

As illustrated in, for example, FIGS. 7 to 10, in the securing member 10 according to the first embodiment, the main bulging portion 30 and the lower bulging portion 35, which is adjacent to and below the main bulging portion 30, bulge from the fixing portion 15 toward the front. In addition, as illustrated in FIG. 10, the first length L1 by which the main bulging portion 30 bulges from the reference surface 15S toward the front is greater than the second length L2 by which the lower bulging portion 35 bulges from the reference surface 15S toward the front. Therefore, the main bulging portion 30 is effectively reinforced by the lower bulging portion 35. Accordingly, the contact surface 31 has a sufficiently large area even when the length of the contact surface 31 in the vertical direction is reduced, more specifically, even when the contact length L31 in the vertical direction illustrated in FIG. 18 is reduced. As a result, even when the first to fourth exterior wall plates 2A1 to 2A4 receive rotating forces R1 and R2 illustrated in FIG. 18 due to wind pressure or the like, the corners of the contact surface 31 do not easily abut against the back surfaces 2B of the first to fourth exterior wall plates 2A1 to 2A4.

Thus, according to the securing member 10 and the exterior structure of the first embodiment, the contact surface 31 has a sufficiently large area so that the exterior wall plates 2 can be stably supported, and the risk that the contact surface 31 will damage the back surfaces 2B of the first to fourth exterior wall plates 2A1 to 2A4 can be reduced.

In addition, in the securing member 10, as illustrated in, for example, FIGS. 7 and 10, the erected portion 19 protrudes not from the reference surface 15S but from the erection surface 36 of the lower bulging portion 35. Accordingly, in the securing member 10, the projecting length L19 of the erected portion 19 illustrated in FIG. 10 can be reduced, and therefore the erected portion 19 is not easily bent. As a result, when the securing member 10 is used, sideways displacement of the first and third exterior wall plates 2A1 and 2A3 can be more effectively prevented.

In addition, in the securing member 10, as illustrated in, for example, FIG. 7, the contact surface 31 includes a pair of horizontally extending surfaces 31U and 31D and a pair of vertically extending surfaces 31L and 31R. Since the main bulging portion 30 is effectively reinforced by the lower bulging portion 35, the vertical length of the area including the pair of horizontally extending surfaces 31U and 31D and the pair of vertically extending surfaces 31L and 31R can be reduced. In addition, the pair of horizontally extending surfaces 31U and 31D and the pair of vertically extending surfaces 31L and 31R form a loop, and therefore do not have end portions. As a result, when the securing member 10 is used, damage to the back surfaces 2B of the first to fourth exterior wall plates 2A1 to 2A4 can be more effectively prevented.

In addition, in the securing member 10, as illustrated in FIG. 10, the second length L2 is greater than half the first length L1. As a result, the main bulging portion 30 can be more effectively reinforced by the lower bulging portion 35.

In addition, in the securing member 10, as illustrated in, for example, FIG. 7, the main bulging portion 30 has the first opening 30H, and the supporting portion 13, the upper engagement portions 11L and 11R, and the lower engagement portion 12 are raised at the periphery of the first opening 30H. The lower bulging portion 35 has the second opening 35H, and the erected portion 19 is raised at the periphery of the second opening 35H. With this structure, the first opening 30H is formed when the supporting portion 13, the upper engagement portions 11L and 11R, and the lower engagement portion 12 are raised, and the second opening 35H is formed when the erected portion 19 is raised. Thus, the manufacturing process of the securing member 10 can be simplified.

In addition, in the securing member 10, as illustrated in FIG. 18, the first opening 30H formed in the main bulging portion 30 and the second opening 35H formed in the lower bulging portion 35 face the ventilation space S1 between the framework 8 and the first to fourth exterior wall plates 2A1 to 2A4 in the fixed state. Accordingly, as indicated by the dashed arrows Y1 in FIG. 18, the first opening 30H and the second opening 35H serve as an inlet and an outlet that allow the air that flows through the ventilation space S1 to appropriately flow into and out of the space S2 surrounded by the securing member 10 and the column 9. More specifically, the air flows upward due to the pressure difference in the ventilation space S1. Therefore, the air flows into the space S2 through the second opening 35H and out of the space S2 through the first opening 30H, and flows upward through the gaps between the back horizontally joining portions 22 and the back vertically joining portions 24 at the back surfaces 2B of the exterior wall plates 2. As a result, the space S2 surrounded by the securing member 10 and the column 9 and portions of the first to fourth exterior wall plates 2A1 to 2A4, the column 9, etc., disposed around the space S2 surrounded by the securing member 10 and the column 9 can be dried. Thus, deterioration of the exterior wall plates 2 and the framework 8 can be reduced.

In addition, in the securing member 10, as illustrated in, for example, FIGS. 7 to 10, the main bulging portion 30 is also effectively reinforced by the upper bulging portion 38 that is adjacent to and above the main bulging portion 30.

In addition, in the securing member 10, as illustrated in, for example, FIG. 7, each U-shaped fixing portion 15B has the fixing holes 15H through which the screws 10B are inserted to fix the fixing portion 15 to the column 9. The inclined surface 39 is pressed in such a shape that the inclined surface 39 does not cover the U-shaped fixing portions 15B. Accordingly, the upper bulging portion 38 includes portions that are adjacent to the fixing holes 15H in the width direction. Thus, as illustrated in FIGS. 16 to 18, the U-shaped fixing portions 15B, which are portions of the fixing portion 15 that are fixed with the screws 10B, come into contact with the column 9 over a large area, and therefore the fixing portion 15 can be securely fixed to the column 9. In addition, owing to the upper bulging portion 38, the head portions of the screws 10B do not project toward the front of the securing member 10. Therefore, when the second and fourth exterior wall plates 2A2 and 2A4 are engaged with the upper engagement portions 11L and 11R, the second and fourth exterior wall plates 2A2 and 2A4 are prevented from coming into contact with the head portions of the screws 10B.

In addition, in the securing member 10, as illustrated in FIG. 10, the inclined surface 39 of the upper bulging portion 38 is inclined so that the length L4 by which the upper bulging portion 38 bulges from the reference surface 15S toward the front increases toward the main bulging portion 30. The lower edge of the inclined surface 39 is connected to the upper surface of the main bulging portion 30, and the connecting portion 39J therebetween is gently curved. Accordingly, when the second and fourth exterior wall plates 2A2 and 2A4 are engaged with the upper engagement portions 11L and 11R, the lower end portions 2D of the second and fourth exterior wall plates 2A2 and 2A4 can be appropriately guided since the upper bulging portion 38 is inclined. As a result, damage due to snagging of the lower end portions 2D of the second and fourth exterior wall plates 2A2 and 2A4 can be suppressed.

Third Operational Effect

In the securing member 10 according to the first embodiment, as illustrated in FIGS. 11, 12, 16, and 18, the projections 17C, 17L, and 17R, which project upward from the supporting portion 13, come into contact with end surfaces of the second and fourth exterior wall plates 2A2 and 2A4 from below, thereby forming a gap W1 illustrated in FIGS. 11 and 12 between the supporting portion 13 and the second and fourth exterior wall plates 2A2 and 2A4 in the fixed state. The area in which the projections 17C, 17L, and 17R come into contact with the end surfaces of the second and fourth exterior wall plates 2A2 and 2A4 is smaller than the area in which the supporting portion 13 will come into contact with the end surfaces of the second and fourth exterior wall plates 2A2 and 2A4 if the projections 17C, 17L, and 17R are not provided. Therefore, rainwater that has flowed along the back surfaces 2B of the second and fourth exterior wall plates 2A2 and 2A4 or along the horizontally joining portion 26 between the second and fourth exterior wall plates 2A2 and 2A4 and accumulated on the supporting portion 13 or rainwater that has been absorbed by dust, dirt, or the like on the supporting portion 13 can be prevented from being in contact with the end surfaces of the second and fourth exterior wall plates 2A2 and 2A4 for a long time. As a result, the second and fourth exterior wall plates 2A2 and 2A4 can be prevented from being damaged by being soaked with the rainwater or the like at the end surfaces thereof. A construction worker may install the first to fourth exterior wall plates 2A1 to 2A4 without realizing that foreign matter, such as dust and dirt, is on the supporting portion 13. Even in such a case, since the projections 17C, 17L, and 17R are provided, the foreign matter is prevented from being sandwiched, and the gap W1 can be reliably formed between the supporting portion 13 and the second and fourth exterior wall plates 2A2 and 2A4. As a result, when the securing member 10 is used, the gap W1 between the supporting portion 13 and the second exterior wall plate 2A2 and the gap W1 between the supporting portion 13 and the fourth exterior wall plate 2A4 can be accurately set without a vertical displacement so that the gap W1 is large enough to prevent the accumulation of rainwater.

Thus, according to the securing member 10 and the exterior structure of the first embodiment, the second and fourth exterior wall plates 2A2 and 2A4 can be maintained in a good condition, and vertical displacement between the second and fourth exterior wall plates 2A2 and 2A4 can be prevented.

In addition, in the securing member 10, as illustrated in, for example, FIGS. 7, 13, and 17, the elastic members 18 provided between the central projection 17C and the left projection 17L and between the central projection 17C and the right projection 17R seal the space between the second exterior wall plate 2A2 and the supporting portion 13 and the space between the fourth exterior wall plate 2A4 and the supporting portion 13. Therefore, the rainwater is prevented from spreading in the width direction along the supporting portion 13.

The second exterior wall plate 2A2 and the fourth exterior wall plate 2A4 are arranged so as to squash the elastic members 18. At this time, a step having a height depending on the amounts by which the elastic members 18 are squashed is formed on the supporting portion 13. However, since the projections 17C, 17L, and 17R are provided on the supporting portion 13, the second exterior wall plate 2A2 and the fourth exterior wall plate 2A4 can always be arranged at a constant position without a vertical displacement therebetween.

In addition, in the securing member 10, as illustrated in, for example, FIGS. 7 and 12, the lower engagement portion 12 is connected to the supporting portion 13 in a central region in the width direction. Therefore, the rainwater on the supporting portion 13 flows downward along the lower engagement portion 12, and is prevented from spreading in the width direction along the supporting portion 13. As a result, the second and fourth exterior wall plates 2A2 and 2A4 can be maintained in a good condition.

Second Embodiment

Figure 22:
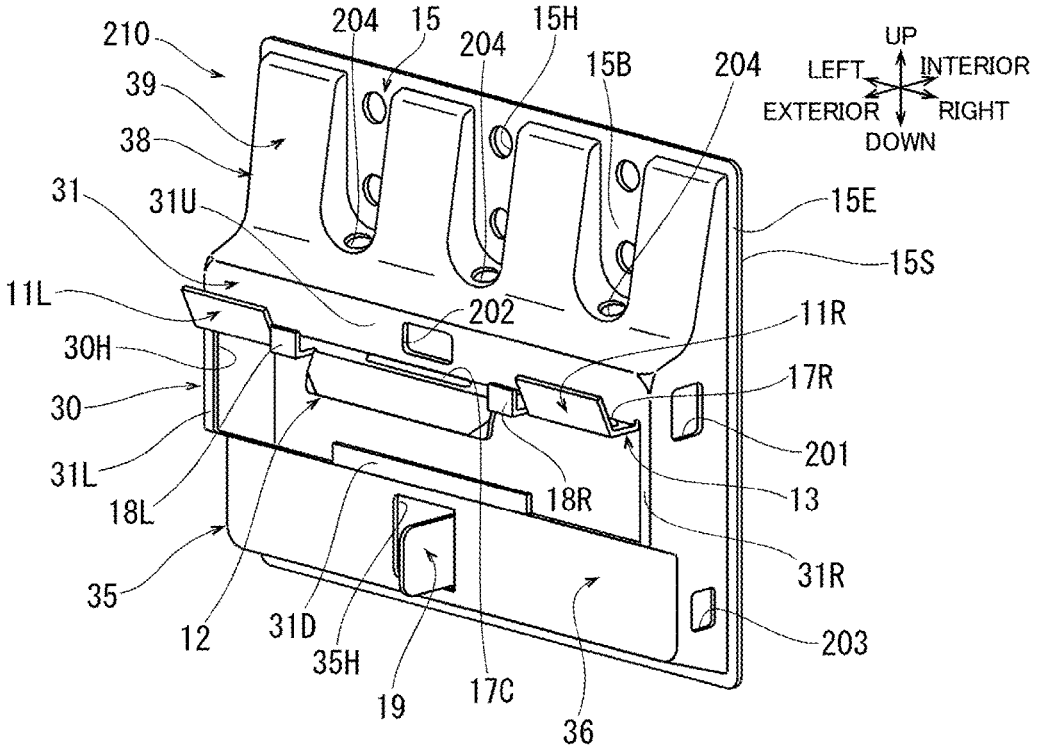
FIG. 22 is a perspective view of a securing member according to a second embodiment.

Referring to FIG. 22, a securing member 210 according to a second embodiment differs from the securing member 10 according to the first embodiment in that a plurality of openings 201, 202, 203, and 204 are additionally formed. In addition, a lower horizontally extending surface 31D of the securing member 210 according to the second embodiment is obtained by cutting left and right portions of the lower horizontally extending surface 31D of the securing member 10 according to the first embodiment in the width direction. Other structures of the second embodiment are the same as those of the first embodiment. Therefore, components that are the same as those in the first embodiment are denoted by the same reference numerals, and description thereof is omitted.

The opening 201 extends through the right surface of the main bulging portion 30. The opening 202 extends through the contact surface 31 of the main bulging portion 30. The opening 203 extends through the right surface of the lower bulging portion 35. Three openings 204 extend through the top surface of the upper bulging portion 38 at positions below the U-shaped fixing portions 15B.

The securing member 210 of the second embodiment provides an operational effect similar to that of the securing member 10 of the first embodiment. In addition, since the openings 201, 202, 203, and 204 are formed, the space S2 surrounded by the securing member 10 and the column 9 illustrated in FIG. 18 and portions of the first to fourth exterior wall plates 2A1 to 2A4, the column 9, etc., disposed around the space S2 can be further dried. Therefore, deterioration of the exterior wall plates 2 and the framework 8 can be further reduced.

Third Embodiment

Figure 23:
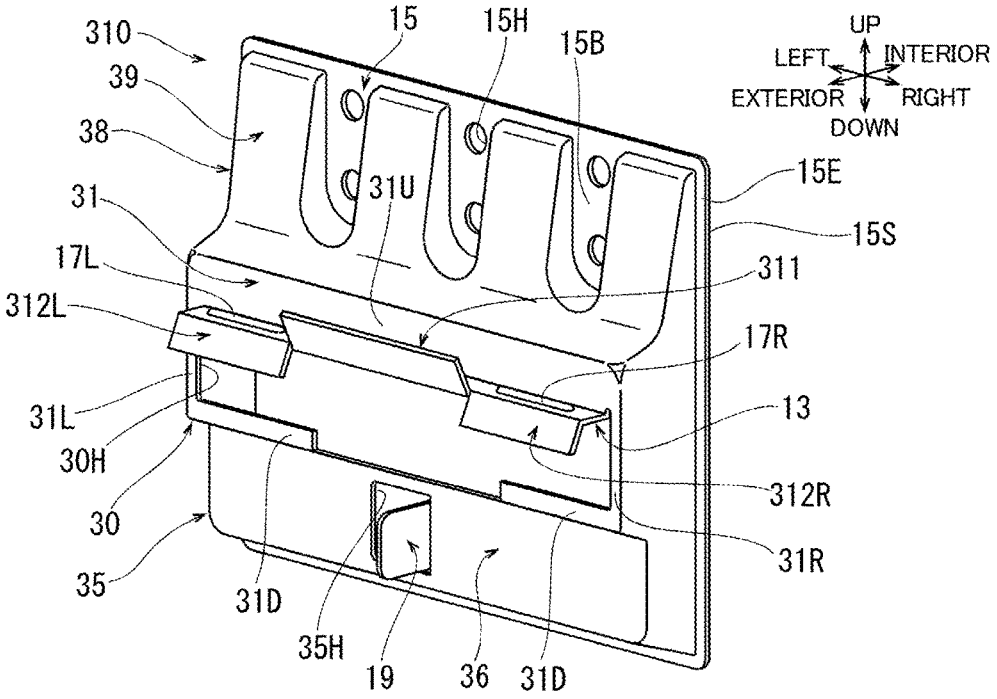
FIG. 23 is a perspective view of a securing member according to a third embodiment.

Referring to FIG. 23, a securing member 310 according to a third embodiment includes an upper engagement portion 311 and lower engagement portions 312L and 312R instead of the upper engagement portions 11L and 11R and the lower engagement portion 12 of the securing member 10 according to the first embodiment. In addition, a lower horizontally extending surface 31D of the securing member 310 according to the third embodiment is obtained by cutting a central portion of the lower horizontally extending surface 31D of the securing member 10 according to the first embodiment in the width direction. Other structures of the third embodiment are the same as those of the first embodiment. Therefore, components that are the same as those in the first embodiment are denoted by the same reference numerals, and description thereof is omitted.

The upper engagement portion 311 is connected to a central portion of the front edge of the supporting portion 13 in the width direction, and is bent upward. The lower engagement portions 312L and 312R are connected to left and right portions of the front edge of the supporting portion 13 and are bent downward.

The securing member 310 of the third embodiment provides an operational effect similar to that of the securing member 10 of the first embodiment.

Fourth Embodiment

Figure 24:
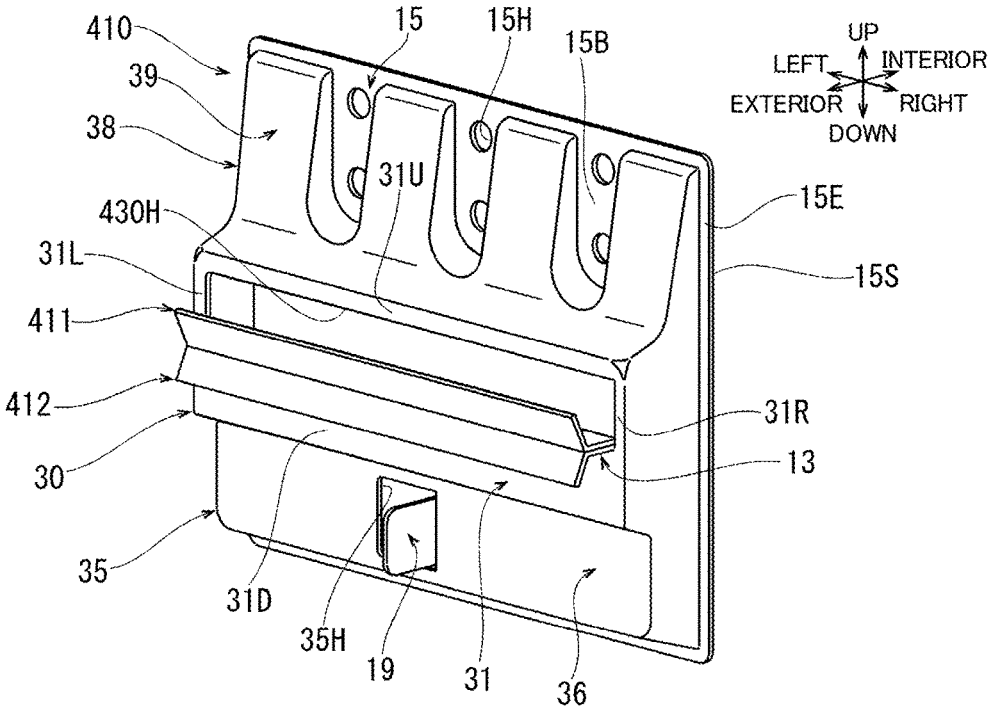
FIG. 24 is a perspective view of a securing member according to a fourth embodiment.

Referring to FIG. 24, a securing member 410 according to a fourth embodiment includes an upper engagement portion 411 and a lower engagement portion 412 instead of the upper engagement portions 11L and 11R and the lower engagement portion 12 of the securing member 10 according to the first embodiment. In addition, in the securing member 410 according to the fourth embodiment, a first opening 430H located above the supporting portion 13 is formed instead of the first opening 30H in the securing member 10 according to the first embodiment. Other structures of the fourth embodiment are the same as those of the first embodiment. Therefore, components that are the same as those in the first embodiment are denoted by the same reference numerals, and description thereof is omitted.

The upper engagement portion 411 is bent upward over the entire width of the front edge of the supporting portion 13. The lower engagement portion 412 is bent downward over the entire width of the front edge of the supporting portion 13.

The securing member 410 of the fourth embodiment provides an operational effect similar to that of the securing member 10 of the first embodiment. In addition, since the width of the upper engagement portion 411 and the lower engagement portion 412 can be increased, the exterior wall plate 2 can be stably attached.

Fifth Embodiment

Figure 25:
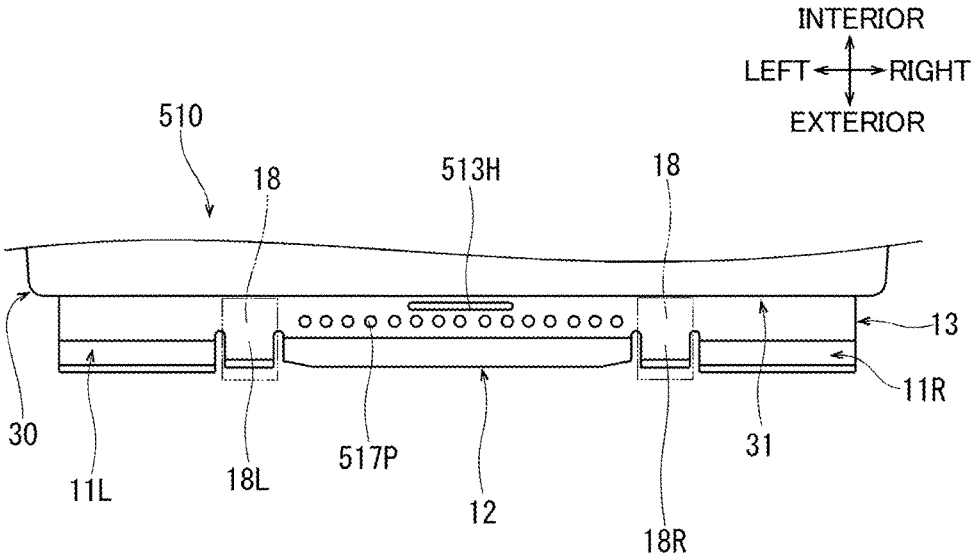
FIG. 25 is a partial top view of a securing member according to fifth embodiment.

Referring to FIG. 25, a securing member 510 according to a fifth embodiment includes projections 517P instead of the projections 17C, 17L, and 17R of the securing member 10 according to the first embodiment. In addition, a through hole 513H is formed in the supporting portion 13. Other structures of the fifth embodiment are the same as those of the first embodiment. Therefore, components that are the same as those in the first embodiment are denoted by the same reference numerals, and description thereof is omitted.

The projections 517P are arranged in a central region of the supporting portion 13 in the width direction. The projections 517P are hemispherical projections that are arranged in the width direction. The projections 517P are arranged in a region extending from a vicinity of the left end of the lower engagement portion 12 to a vicinity of the right end of the lower engagement portion 12.

The projections 517P are located so as to be separated from the front end of the supporting portion 13 toward the contact surface 31, the front end being adjacent to the upper engagement portions 11L and 11R and the lower engagement portion 12. In addition, the projections 517P are also located so as to be separated from the contact surface 31 toward the upper engagement portions 11L and 11R and the lower engagement portion 12. Thus, the projections 517P reliably provide the gap W1 between the supporting portion 13 and the second and fourth exterior wall plates 2A2 and 2A4. The gap W1 between the supporting portion 13 and the second exterior wall plate 2A2 and the gap W1 between the supporting portion 13 and the fourth exterior wall plate 2A4 can be accurately set without a vertical displacement, and accumulation of rainwater can be prevented.

The through hole 513H is thin and extends in the width direction in a space between the contact surface 31 and the projections 517P. The shape and number of through holes 513H are not limited to this.

The securing member 510 of the fifth embodiment provides an operational effect similar to that of the securing member 10 of the first embodiment.

In the securing member 510, the dot-shaped projections 517P reliably provide a gap that is large enough to reduce the accumulation of rainwater between the supporting portion 13 and the second and fourth exterior wall plates 2A2 and 2A4.

In addition, in the securing member 510, the rainwater on the supporting portion 13 flows downward through the through hole 513H. Therefore, the rainwater is prevented from spreading in the width direction along the supporting portion 13.

Sixth Embodiment

In the above-described first to fifth embodiments, the supporting portion 13 is integrated with the upper engagement portions 11L and 11R and the lower engagement portion 12. However, although not illustrated, the supporting portion 13 may be separated from the upper engagement portions 11L and 11R and the lower engagement portion 12 at connecting portions therebetween. In such a case, the rainwater on the supporting portion 13 flows downward through the gaps between the supporting portion 13 and each of the upper engagement portions 11L and 11R and the lower engagement portion 12, and is prevented from spreading in the width direction along the supporting portion 13.

Although embodiments of the present invention are described above, the present invention is not limited to the above-described embodiments, and various modifications are, of course, possible within the scope of the present invention.

Although the projections 17C, 17L, and 17R are provided on the supporting portion 13 in the first embodiment, the present invention is not limited to this configuration. For example, the projections 17C, 17L, and 17R on the supporting portion 13 may be omitted, and the end surfaces of the second and fourth exterior wall plates 2A2 and 2A4 may be brought into direct contact with the top surface of the supporting portion 13.

What is claimed is:

1. A securing member for attaching a first exterior member, a second exterior member, a third exterior member, and a fourth exterior member to a framework of a building, the second exterior member being adjacent to and above the first exterior member, the third exterior member being adjacent to the first exterior member at one side in a horizontal direction, the fourth exterior member being adjacent to and above the third exterior member and being adjacent to the second exterior member at the one side in the horizontal direction, the securing member comprising:

a fixing portion that includes a reference surface, that is configured to be fixed to the framework at the reference surface, and that has at least one fixing hole that allows a fastener to be inserted through the fixing portion;

a supporting portion that projects from the fixing portion to support the second exterior member and the fourth exterior member;

an upper engagement portion that is provided on the supporting portion so as to extend upward to engage with the second exterior member and the fourth exterior member;

a lower engagement portion that is provided on the supporting portion so as to extend downward to engage with the first exterior member and the third exterior member; and an erected portion that projects from the fixing portion and that is configured to be disposed between opposing end portions of the first exterior member and the third exterior member, wherein the erected portion is disposed on a center line of the fixing portion in a width direction, wherein a specific fixing hole, which is one of the at least one fixing hole that is closest to the center line, is displaced from the center line toward one side in the width direction, and wherein the at least one fixing hole is arranged asymmetrically about the center line.

2. The securing member according to claim 1, wherein one end portion of each exterior member in the horizontal direction includes a back horizontally joining portion that is recessed from a front surface of the exterior member toward a back surface of the exterior member and that extends in a vertical direction, and wherein the other end portion of each exterior member in the horizontal direction includes a front horizontally joining portion that is recessed from the back surface of the exterior member toward the front surface of the exterior member and that extends in the vertical direction.

3. The securing member according to claim 2, wherein a distance by which the specific fixing hole is displaced from the center line is greater than or equal to ¼ of an overlapping width by which the back horizontally joining portion and the front horizontally joining portion overlap, and is less than or equal to ¾ of the overlapping width.

4. The securing member according to claim 1, wherein a plurality of the specific fixing holes are arranged in a vertical direction.

5. A securing member for attaching a first exterior member, a second exterior member, a third exterior member, and a fourth exterior member to a framework of a building, the second exterior member being adjacent to and above the first exterior member, the third exterior member being adjacent to the first exterior member at one side in a horizontal direction, the fourth exterior member being adjacent to and above the third exterior member and being adjacent to the second exterior member at the one side in the horizontal direction, the securing member comprising:

a fixing portion that includes a reference surface and that is fixed to the framework at the reference surface;

a main bulging portion that bulges from the fixing portion;

a contact surface that is formed on the main bulging portion and that comes into contact with back surfaces of the first exterior member, the second exterior member, the third exterior member, and the fourth exterior member;

a supporting portion that projects beyond the contact surface of the main bulging portion, that extends in a width direction of the main bulging portion, and that supports the second exterior member and the fourth exterior member;

an upper engagement portion that is attached to the supporting portion and that engages with the second exterior member and the fourth exterior member;

a lower engagement portion that is attached to the supporting portion and that engages with the first exterior member and the third exterior member;

a lower bulging portion that bulges from the fixing portion and that is adjacent to and below the main bulging portion; and an erected portion that projects from the lower bulging portion and that is disposed between opposing end portions of the first exterior member and the third exterior member, wherein a first length by which the main bulging portion bulges from the reference surface is greater than a second length by which the lower bulging portion bulges from the reference surface, and wherein a third length from the reference surface to a front end of the erected portion is greater than the first length.

6. The securing member according to claim 5, wherein the contact surface includes a pair of horizontally extending surfaces that are above and below the supporting portion, a pair of vertically extending surfaces that are on both sides of the main bulging portion in the width direction, and wherein the pair of horizontally extending surfaces and the pair of vertically extending surfaces for in a loop.

7. The securing member according to claim 5, further comprising a projection that is located so as to be separated from a front end of the supporting portion toward the contact surface, the front end being adjacent to the upper engagement portion and the lower engagement portion, and separated from the contact surface toward the upper engagement portion and the lower engagement portion.

8. An exterior structure of a building, comprising:

a plurality of exterior members including a first exterior member, a second exterior member, a third exterior member, and a fourth exterior member, the second exterior member being adjacent to and above the first exterior member, the third exterior member being adjacent to the first exterior member at one side in a horizontal direction, the fourth exterior member being adjacent to and above the third exterior member and being adjacent to the second exterior member at the one side in the horizontal direction;

a framework of the building; and a securing member for attaching the plurality of exterior members to the framework, wherein the securing member comprises:

a fixing portion that includes a reference surface, that is fixed to the framework at the reference surface, and that has at least one fixing hole that allows a fastener to be inserted through the fixing portion;

a supporting portion that projects from the fixing portion and supports the second exterior member and the fourth exterior member;

an upper engagement portion that is provided on the supporting portion so as to extend upward and engages with the second exterior member and the fourth exterior member;

a lower engagement portion that is provided on the supporting portion so as to extend downward and engages with the first exterior member and the third exterior member; and an erected portion that projects from the fixing portion and that is disposed between opposing end portions of the first exterior member and the third exterior member, wherein the erected portion is disposed on a center line of the fixing portion in a width direction, wherein a specific fixing hole, which is one of the at least one fixing hole that is closest to the center line, is displaced from the center line toward one side in the width direction, and wherein the at least one fixing hole is arranged asymmetrically about the center line.

* * * * *